US007860416B2

(12) United States Patent
Itagaki

(10) Patent No.: US 7,860,416 B2
(45) Date of Patent: Dec. 28, 2010

(54) IMAGE FORMING APPARATUS

(75) Inventor: Tomohisa Itagaki, Abiko (JP)

(73) Assignee: Canon Kabushiki Kaisha (JP)

( * ) Notice: Subject to any disclaimer, the term of this patent is extended or adjusted under 35 U.S.C. 154(b) by 390 days.

(21) Appl. No.: 12/025,663

(22) Filed: Feb. 4, 2008

(65) Prior Publication Data

US 2008/0187336 A1 Aug. 7, 2008

(30) Foreign Application Priority Data

Feb. 7, 2007 (JP) ..... 2007-028274

(51) Int. Cl.
*G03G 15/10* (2006.01)

(52) U.S. Cl. ..... 399/64; 399/60; 399/74

(58) Field of Classification Search ..... 399/49, 399/52, 60, 64, 74
See application file for complete search history.

(56) References Cited

U.S. PATENT DOCUMENTS

2004/0144911 A1* 7/2004 Stam et al. ..... 250/208.1
2005/0281574 A1* 12/2005 Yamamoto et al. ..... 399/49
2006/0199729 A1* 9/2006 Naganuma et al. ..... 502/228

FOREIGN PATENT DOCUMENTS

| | | | |
|---|---|---|---|
| JP | 5-322760 A | | 12/1993 |
| JP | 9-319270 A | | 12/1997 |
| JP | 11-347418 A | | 12/1999 |
| JP | 2002072612 A | * | 3/2002 |
| JP | 2003-228201 A | | 8/2003 |

* cited by examiner

*Primary Examiner*—David M Gray
*Assistant Examiner*—Barnabas T Fekete
(74) *Attorney, Agent, or Firm*—Rossi, Kimms & McDowell LLP

(57) ABSTRACT

An image forming apparatus which is capable of decreasing the failure rate by improving a photocatalytic material and utilization efficiency thereof, and by decomposing substances that cannot be completely removed with a cleaning member or by not causing the substances to adhere. A light emitting unit irradiates an object to be irradiated with light. A light receiving unit receives reflected light from the irradiated object. A protection sheet containing a photocatalytic material is disposed so as to cover the light emitting unit and light receiving unit. The light emitting unit emits light of a wavelength range adapted to a bandgap width of the protection sheet, and the light receiving unit has sensitivity in a wavelength range of light emitted from the light emitting unit.

9 Claims, 14 Drawing Sheets

IMAGE FORMING APPARATUS

BACKGROUND OF THE INVENTION

1. Field of the Invention

The present invention relates to an image forming apparatus such as an electrophotographic multi-functional peripheral or printer.

2. Description of the Related Art

It is very important for an image forming apparatus to stabilize the quality of an image to be formed. Generally, in an electrophotographic image forming apparatus, the density of an image to be formed (for example, the amount of a color material) is unstable due to variations in respective units (for example, the amount of electric charge retained by a color material) under image forming processing, and changes in installation environment (for example, temperature, humidity). Variations in sensitivity of a photoreceptor and changes in the environment for a transfer member also make the density of an image to be formed unstable.

The mainstream of a method to stabilize an image to be formed is a method to control development conditions (for example, see Japanese Laid-Open Patent Publication (Kokai) No. H09-319270) and a method to change image data (for example, see Japanese Laid-Open Patent Publication (Kokai) No. 2003-228201).

In the method to control development conditions, first, a patch image is formed on a photoreceptor or transfer member. Next, the toner density of the formed patch image is detected. Then, depending on the detected toner density, the ratio of magnetic powder to toner in a developing device is controlled.

In the method to change image data, the toner density of the formed patch image is detected similarly. Then, depending on the detected toner density, contents of a γLUT (gamma look-up table) are changed. A γLUT is a table to perform one-dimensional transformation on image data. The γLUT can decide output values (density signals 0 to 255) for inputted data (mainly, density signals 0 to 255).

A sensor for detecting the above patch image has a shutter member or cleaning member for preventing stains such as toners or dust on a window of the sensor (for example, see Japanese Laid-Open Patent Publication (Kokai) No. H05-322760).

There has been well known a technique using photocatalysis as typical method for preventing stains and dirt from being attached. Particularly, in the construction industry, a photocatalytic coating agent is used for the exterior such as external walls or window glass as well as for the interior. A photocatalytic coating agent has an effect to control propagation of various types of bacteria or mold, hence is used for an air cleaner. The agent is widely used for car coating, etc. (for example, see Japanese Laid-Open Patent Publication (Kokai) No. H11-347418).

For an image forming apparatus, many techniques using photocatalysis have been proposed. For example, a technique has been proposed to enable paper recycling by decomposing biding resin contained in toners to make toners to be detachable from paper (for example, see Japanese Laid-Open Patent Publication (Kokai) No. H11-338184).

However, the shutter member of a sensor typically opens during image formation, during which toners or stains adhere to the sensor. The adhered stains can be partially removed by the cleaning member, though repetitive cleaning firmly puts the stains on a protection film of the sensor.

The cleaning member is effective for toner having particles, large dust or paper dust to a certain extent. However, it cannot remove adhered volatile substances (silicone oil or wax components in toner, etc.) that generates in the image forming apparatus. In that case, the substances must be wiped out with ethanol by a service person or the sensor must be replaced.

However, the ethanol wiping causes turbidity phenomenon referred to as white turbidity on a transparent part such as a weak chemical-resistant protection layer or LED cover, decreasing sensor outputs and making density detection difficult. A film having a photocatalytic function can be arranged on or a coating agent can be applied for the above sensor to aim decomposition of stains. However, the light use efficiency is low in conventional states. To be more effective, a significant time is required and hence the technique has not been actually utilized.

To accelerate a photocatalytic reaction, a light source dedicated to sensor cleaning can be prepared. In that case, securement of a space and the cost to arrange a new light source may be barriers. Many light detecting devices can only detect a distance of several mm, having no spare space. Currently, no available image forming apparatus includes a light detecting device including the light source dedicated to sensor cleaning.

SUMMARY OF THE INVENTION

The present invention provides an image forming apparatus which is capable of decreasing the failure rate by improving a photocatalytic material and utilization efficiency thereof, and by decomposing substances that cannot be completely removed with a cleaning member or by not causing the substances to adhere.

In an aspect of the present invention, there is provided an image forming apparatus comprising a light emitting unit adapted to irradiate an object to be irradiated with light, a light receiving unit adapted to receive reflected light from the irradiated object, and a photocatalytic layer disposed so as to cover at least one of the light emitting unit and the light receiving unit, the photocatalytic layer containing a photocatalytic material, and the light emitting unit is adapted to emit light of a wavelength range adapted to a bandgap width of the photocatalytic layer, and the light receiving unit is adapted to have sensitivity in a wavelength range of light emitted from the light emitting unit.

According to the present invention, a photocatalytic material and use efficiency thereof can be improved, substances that cannot be completely removed with a cleaning member are decomposed or not adhered, to thereby make it possible to decrease the failure rate of the image forming apparatus.

Further features and advantages of the present invention will become apparent from the following detailed description of exemplary embodiments with reference to the attached drawings.

DETAILED DESCRIPTION OF THE PREFERRED EMBODIMENTS

Embodiments of the present invention will be described in detail with reference to drawings showing preferred embodiments thereof.

The present invention relates to a technique to prevent stains on a light sensor using photocatalysis. Particularly, a current ultraviolet ray emitting apparatus being generally used emits a low amount of light (radiant flux) than sunlight. The present invention provides the use of the low amount of light, which will be described below in detail.

Figure 1:
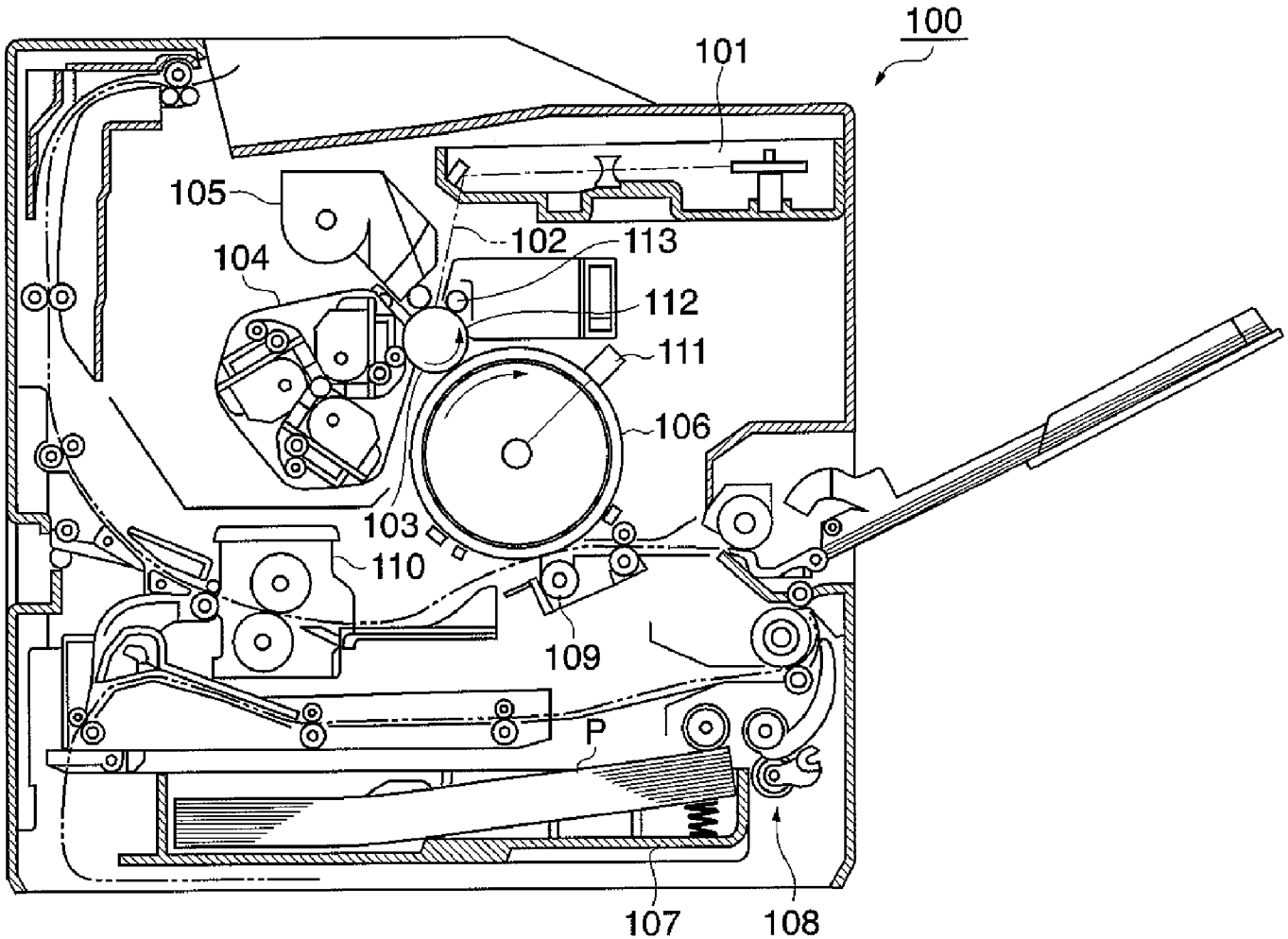
FIG. 1 is a diagram schematically showing an the configuration of an image forming apparatus according to a first embodiment of the present invention.

FIG. 1 is a diagram schematically showing the configuration of an image forming apparatus according to a first embodiment of the present invention. Herein, an electrophotographic color laser beam printer 100 will be taken as one example of the image forming apparatus.

The printer 100 employs a so-called rotary image forming station. It is needless to say that the present invention can be applied similarly to a tandem image forming station. A tandem image forming station generally comprises a plurality of image forming units arranged in parallel and an intermediate transfer belt. A configuration of such a tandem image forming station is known, and therefore detailed description thereof is omitted.

A configuration and operation of the image forming apparatus in FIG. 1 will be described hereinbelow.

In FIG. 1, a scanner unit 101 is comprised of a light source and a polygon mirror, for example. Output light 102 from the light source (for example, a laser diode or LED) is modulated depending on image data for each color component obtained based on print data.

A polygon mirror scans a photosensitive drum 103 to form an electrostatic latent image. The drive force of a drive motor (not shown) is transmitted to the photosensitive drum 103, whereby the photo sensitive drum 103 rotates counterclockwise according to image forming operation.

When the electrostatic latent image is developed using color materials (for example, developers such as toners), a visible image (toner image) is obtained. A rotary developing device 104 is comprised of, for example, a three-color developing device for yellow (Y), magenta (M) and cyan (C) development. The rotary developing device 104 rotates so that it can select toners transcribed on the photosensitive drum 103. In this embodiment, a black developing device 105 is provided separately from the rotary developing device 104.

Visible images formed on the photosensitive drum 103 are multiply-transcribed on an intermediate transfer member 106 in order. In this manner, a visible color image is formed. The photosensitive drum 103 that has transcribed toners on the intermediate transfer member 106 collects unnecessary remaining toners (not transcribed) by a blade cleaning apparatus 112 and is charged by a roller charging apparatus 113 to prepare for the next latent image formation.

Transfer material P (for example, a sheet) loaded to a paper cassette 107 is conveyed to a transfer unit 109 by a sheet feeding unit 108 including a plurality of rollers. A visible color image is transferred onto the transfer material P in the transfer unit 109. Further, a fixing unit 110 fixes the visible color image on the transfer material P.

A density sensor 111 (hereinafter, also referred to simply as a sensor) detects the density (amounts of color materials) of a visible image formed on the intermediate transfer member 106. This first embodiment relates to the prevention of stains on the density sensor 111. A detailed configuration of the sensor will be described later. The density sensor 111 is arranged so as to radiate light toward the center of a roller; specifically, arranged so as to radiate light in the direction of 45 degrees under the body, as disclosed in Japanese Laid-Open Patent Publication (Kokai) No. 2002-72574.

Figure 2:
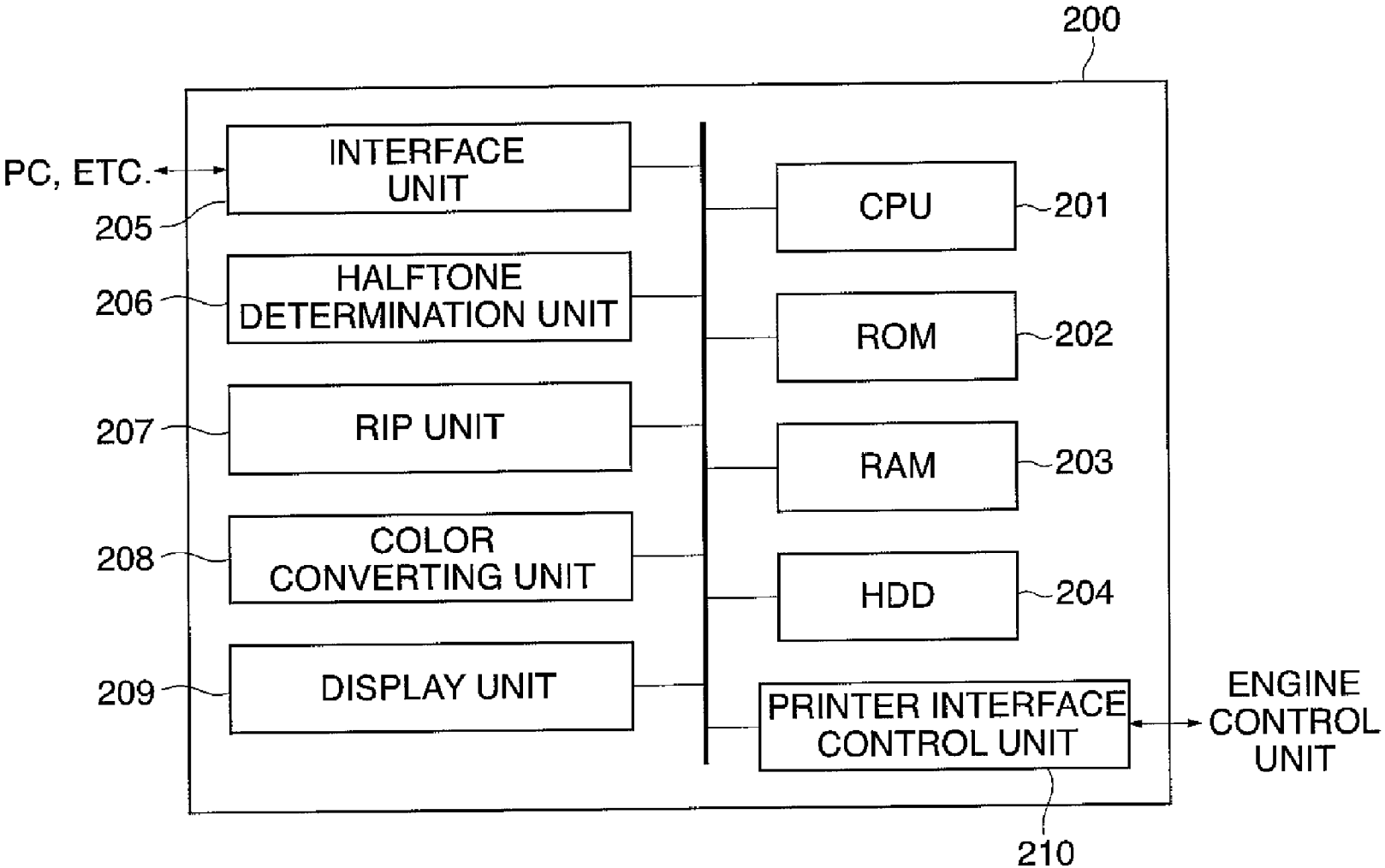
FIG. 2 is a block diagram showing a controller of the image forming apparatus in FIG. 1.

FIG. 2 is a block diagram showing a controller of the image forming apparatus in FIG. 1.

In FIG. 2, a CPU 201 is a control circuit that centrally controls respective units of a controller 200. A ROM 202 is a non-volatile storage unit for storing a control program, for example. A RAM 203 is a volatile storage unit that functions as a work area for the CPU 201. An HDD (hard disk drive apparatus) 204 is a mass storage unit for storing various data.

An interface unit 205 inputs data (for example, data described in a page description language (PDL)) to be printed that is sent from a PC (personal computer) or other controllers, and image data in the PDF or Tiff format. A halftone determination unit 206 determines whether or not halftone processing has been performed on the inputted image data, or distinguishes details of the halftone processing.

An RIP (Raster Image Processor) unit 207 converts the inputted image data into a bit map image, for example (raster processing). A color converting unit 208 converts a color space of the inputted image data. For example, the unit 208 converts a color space such as RGB or L*a*b* into CMYK being a color space of the printer unit.

The image data subjected to the raster processing and color conversion is sent to an engine control unit (FIG. 3) via a printer interface control unit 210.

A display unit 209, which is a display circuit such as an LCD display apparatus, displays a status of the printer 100 or the controller 200, for example. The display unit 209 can also be an operation unit with a touch panel.

Figure 3:
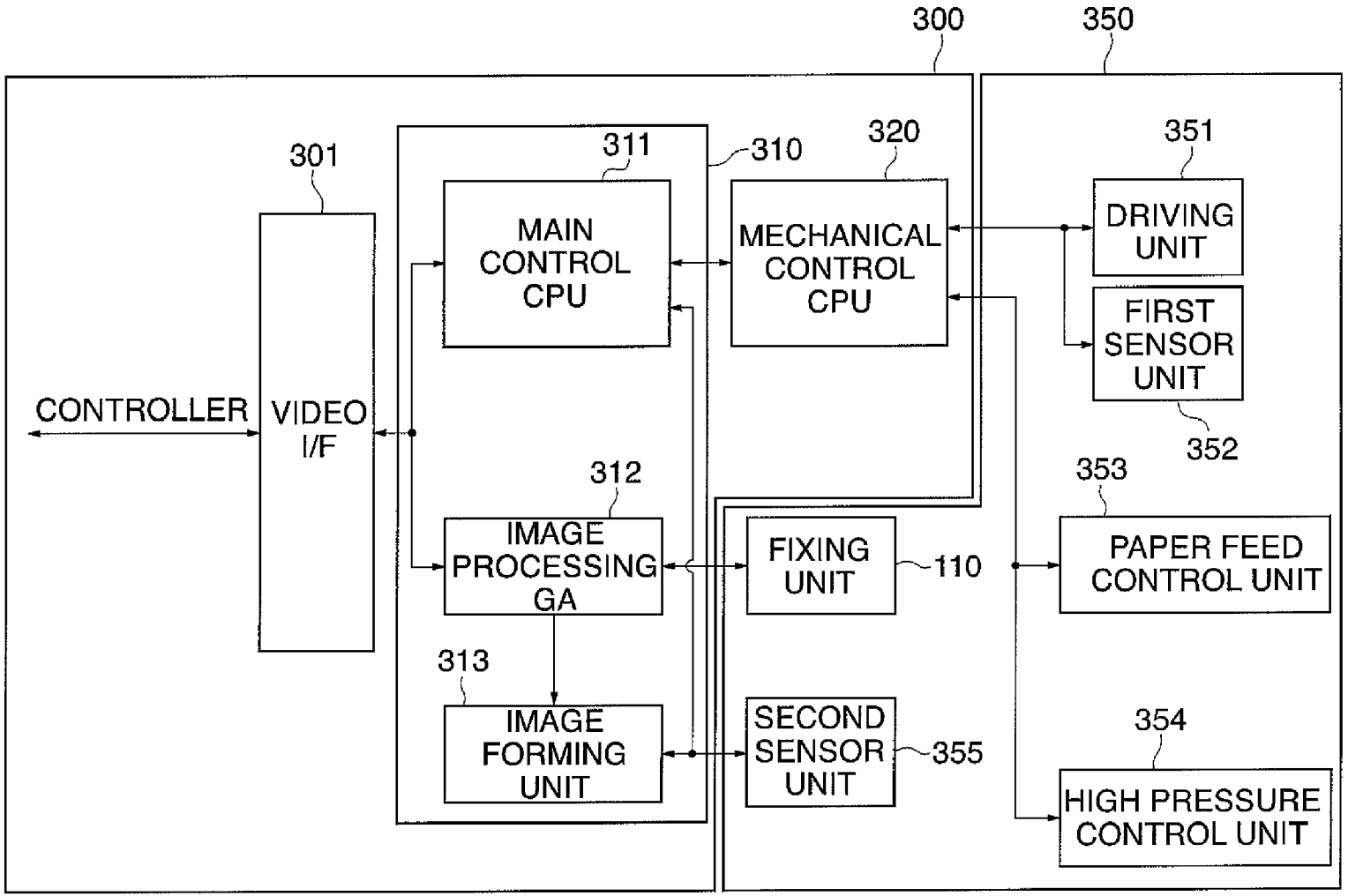
FIG. 3 is a block diagram showing an engine control unit and a printer engine unit of the image forming apparatus in FIG. 1.

FIG. 3 is a block diagram showing an engine control unit and a printer engine unit of the image forming apparatus in FIG. 1.

The printer 100 is comprised of the controller 200, an engine control unit 300, and a printer engine unit 350.

In the engine control unit 300, a video interface 301 is an interface circuit for connecting to the controller 200. A main control unit 310 includes a main control CPU 311, an image processing gate array 312, and an image forming unit 313.

The main control CPU 311 is a control circuit that centrally controls respective units of the printer engine unit 350 and controls a mechanical control CPU 320 as a sub CPU. The image processing gate array 312 is an image processing circuit for performing γ-correction, for example, on image data received by the video interface 301.

The image forming unit 313 controls the amount of exposure light and emission time of a laser beam. The mechanical control CPU 320 controls a driving unit 351, a first sensor unit 352, a paper feed control unit 353, and a high pressure control unit 354, for example, of the printer engine unit 350.

In the printer engine unit 350, the driving unit 351 has a motor, clutch or fan, etc. The first sensor unit 352 is a sensor for detecting the position of transfer material P. The paper feed control unit 353 controls feeding of the transfer material P. The high pressure control unit 354 controls the charged amount of the photosensitive drum 103 or a transfer bias of a transfer roller, etc.

The printer engine unit 350 also includes the fixing unit 110 and a second sensor unit 355 in addition to the driving unit 351, the first sensor unit 352, the paper feed control unit 353, and the high pressure control unit 354 described above. The second sensor unit 355 is a temperature sensor, humidity sensor, remaining toner amount detecting sensor, for example.

Figure 4:
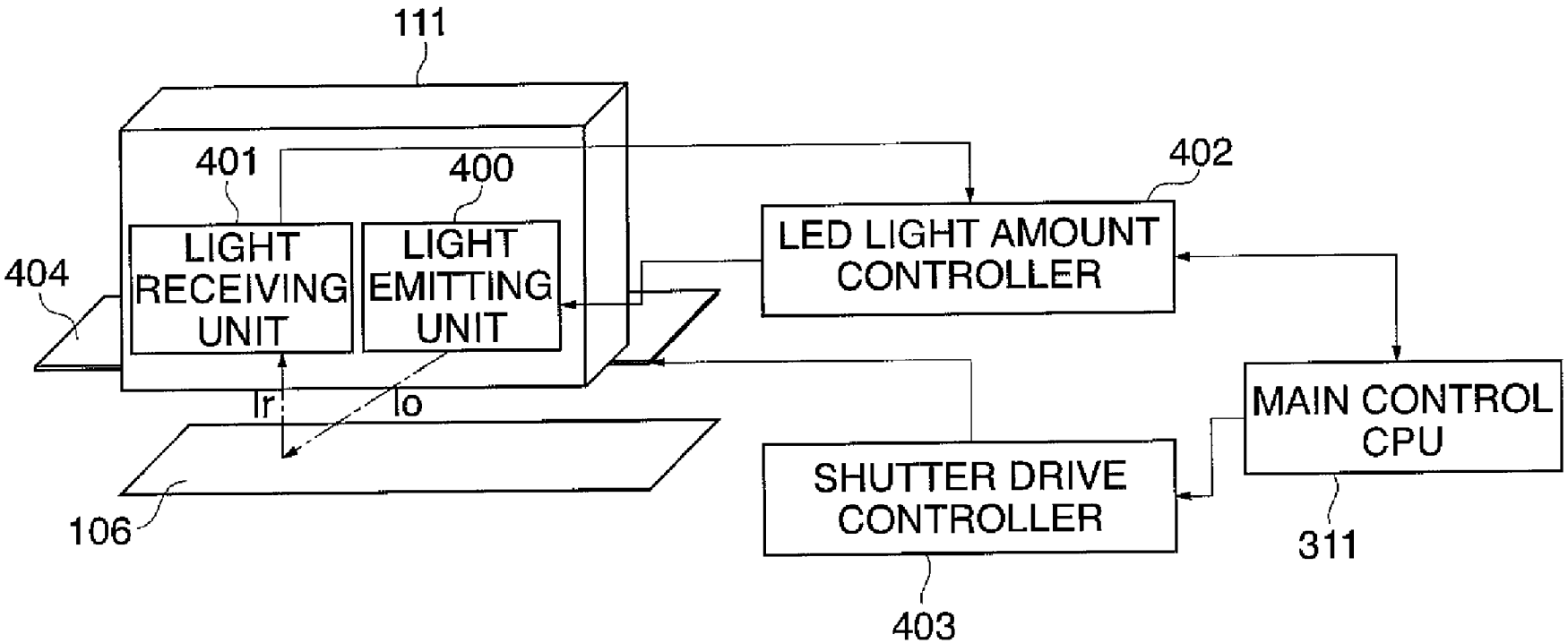
FIG. 4 is a block diagram showing a density sensor in FIG. 1 and the related units.

FIG. 4 is a block diagram showing the density sensor in FIG. 1 and the related units.

In FIG. 4, the density sensor 111 is included in the second sensor unit 355. The density sensor 111 comprises a light emitting unit 400 such as an LED (light emitting diode) and a light receiving unit 401 such as a PD (photodetector).

Light Io radiated from the light emitting unit 400 to the intermediate transfer member 106 reflects on the surface of the intermediate transfer member 106. The light receiving unit 401 receives reflected light Ir and outputs the amount of the received light.

The amount of the reflected light Ir outputted from the light receiving unit 401 is monitored by an LED light amount control unit 402. The LED light amount control unit 402 notifies the main control CPU 311 of the amount of the reflected light Ir. The main control CPU 311 calculates the density of a patch image based on the emission strength of the radiated light To and the amount (measured value) of the received reflected light Ir. Except when image output is performed, the CPU 311 controls a shutter drive control unit 403 to operate a shutter 404.

The density sensor 111 is used for control to stabilize a color tone of an image to be formed. That is, the density sensor 111 detects a patch image formed on trial on the intermediate transfer member 106.

Representative examples of the stability control are the Dmax control and the halftone control (for example, see Japanese Laid-Open Patent Publication (Kokai) No. H7-92385). In the so-called Dmax control, first, a plurality of color material images are created on trial by changing the amount of exposure light, a development power voltage, and a charged power voltage. The density of each created color material image is measured, and the amount of exposure light, the development power voltage, and the charged power voltage value are calculated corresponding to the maximum target density of each color based on the measured value, respectively.

On the other hand, in the halftone control, for example, the amount of exposure light, the development power voltage, and the charged power voltage value are used that are calculated in the Dmax control. Further, color material images in several stages subjected to the halftone processing such as the screen are created on trial. Densities of the created color material images are measured, and a γLUT (gamma look-up table) is created based on the measured densities.

A γLUT is a table to correct the relationship between an input and an output such that an output result of an input signal satisfies a target density feature. The γLUT is stored in the image processing gate array 312 and used for the next image formation.

Figure 5:
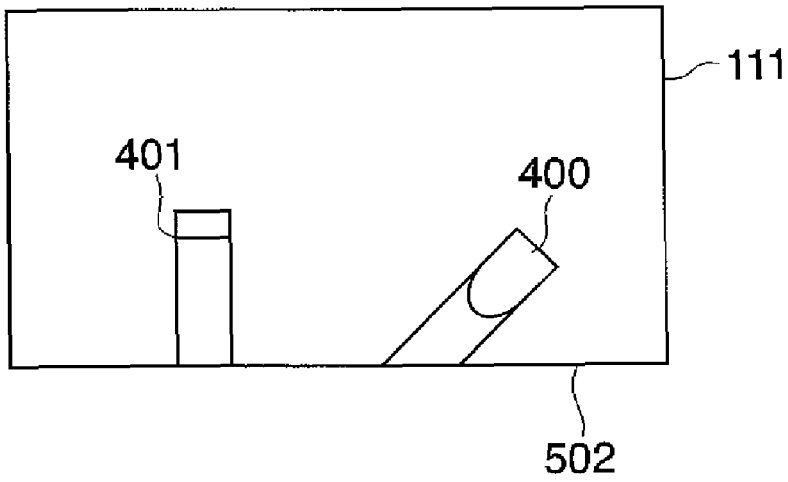
FIG. 5 is a diagram schematically showing the configuration of the density sensor in FIG. 4.

FIG. 5 is a diagram schematically showing the configuration of the density sensor in FIG. 4.

In the density sensor 111 in FIG. 5, the relationship between the light emitting unit 400 and the light receiving unit 401 means the relationship of diffusely reflected light (also referred to as scattering light). Further, a dust-proof protection sheet 502 prevents grit, dust, toners, magnetic materials, etc. from getting into the light emitting unit 400 and the light receiving unit 401.

Figure 6:
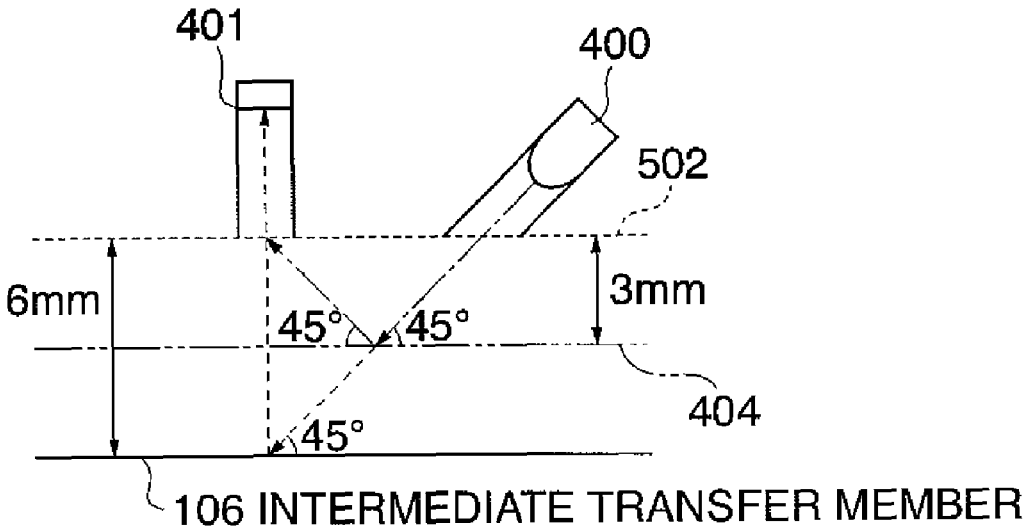
FIG. 6 is a diagram of the optical configuration of the density sensor in FIG. 4.

FIG. 6 is a diagram of the optical configuration of the density sensor in FIG. 4.

In FIG. 6, during the above Dmax control and halftone control for image formation, the light emitting unit 400 irradiates the intermediate transfer member 106 with light at an angle of 45°, while the light receiving unit 401 receives the light at an angle of 0°. The shutter 404 laminated with a metallic film (for example, aluminum) as a mirror is optically arranged such that light provides an image by regularly reflecting (also referred to as totally reflecting) on a window of the light receiving unit 401.

A distance from the protection sheet 502 to the intermediate transfer member 106 is 6 mm, while a distance from the protection sheet 502 to the shutter 404 is 3 mm. The protection sheet 502 is constituted of photocatalytic film, and the shutter 404 is also constituted of a mirror photocatalytic film.

The mirror photocatalytic film used in this embodiment is a thin-film mirror having a photocatalytic function disclosed in Japanese Laid-Open Patent Publication (Kokai) No. 2000-285716. Although the above configuration is employed because of a narrow space between the sensor and the shutter, scratch-resistant glass can also be used if the focus distance can be maintained.

If the glass is employed, the thickness must be taken into account. Since glass is thick (several mm), normally reflected light is calculated on the surface of metal (aluminum) instead of the surface of the protection layer. Preferably, the glass surface is photocatalytically coated to form a photocatalytic layer and radiated ultra violet light can decompose stains.

Although the mirror is made of aluminum in this embodiment, other metal can also be used if the features of the mirror can be maintained.

The features of a mirror are defined such that the ratio of the amount of light at the mirror side to the amount of light at the sensor light receiving window unit is less than 10%. A shutter is arranged that can efficiently irradiate the window of the light receiving unit by such a material to avoid the influence of stains.

As disclosed in Japanese Laid-Open Patent Publication (Kokai) No. H5-322760, a cleaning member is loaded to the shutter 404, which is known as a prior art and therefore description thereof is omitted. The cleaning member removes large toners and stains and photocatalytic decomposes micro stains, sticking toners, etc.

An LED used in the light emitting unit 400 is a UVLED. In this embodiment, titanium oxide ($TiO_2$) is employed for the photocatalytic layer, of which bandgap width is about 3.2 eV and the applicable wavelength is about 387.5 nm or less.

Accordingly, an ultraviolet ray LED is optimum as the light emitting unit 400 if a titanium-oxide photocatalytic layer is used. A white light source capable of emitting ultraviolet rays can also be used. However, it is required to determine whether or not the amount of the emitted ultraviolet rays is adapted to this embodiment.

In this embodiment, a round type LED (NSHU590B) by Nichia Corporation is used for the light emitting unit 400. A surface-emitting type with a higher amount of light (I-LED NCCU03) can also be used. However, a window should be arranged so as to define a light flux or light path.

The sensor used in the light receiving unit 401 must be a sensor that is sensitive in the ultraviolet band. In this embodiment, the GaAsP photodiode G5842 by Hamamatsu Photonics K.K. is employed. In this configuration, a UV sensor is optimum so as to sense other wavelength bands as little as possible. For example, the SMD-Type GaN UV Sensor KPDU34PSI by Kyosemi Corporation can be used, for example.

A visible light band sensor can also be used that is sensitive at around 387 nm. For example, such a sensor includes the Si PIN photodiode S5973-02 by Hamamatsu Photonics K.K.

<Photocatalytic Film>

The photocatalytic film herein is a typical photocatalytic film comprised of an organic base layer, a barrier layer and a photocatalytic layer as disclosed in Japanese Laid-Open Patent Publication (Kokai) No. H10-278168, for example.

A plastic material (for example, polyester, polyethylene) is often employed for the base layer. A plastic material is basically an organic material; if a photocatalytic layer is bonded to the material, a photocatalytic reaction occurs. Accordingly, a barrier layer (also referred to as an evaporated layer) needs to be provided.

For example, oxide ceramics, silicon, aluminum or silica is often used for the barrier layer.

Many manufacturers employ titanium oxide as a main constituent of a photocatalytic layer. This is because the material has balanced features of both of oxidative power and reducing power, does not cause self-fusion, has durability, for example.

However, ZnO, $SrTiO_3$, CdS, CaP, InP, GaAs, $BaTiO_3$, $K_2TiO_3$, $K_2NbO3$, $Fe_2O_3$, $Ta_2O_3$ and $WO_3$ can be used in addition to TiO2 for the photocatalytic layer if they are adapted to the application of this embodiment.

Similarly, $SnO_2$, $Bi_2O_3$, NiO, $Cu_20$, SiC, $SiO_2$, $MoS_2$, InPb, $RuO_2$, $CeO_2$, etc. can be used for the photocatalytic layer. Substances mixed with metal such as Pt, Rh, $RuO_2$, Nb, Cu, Sn, Ni, or Fe to the above substances can also be used.

Any material can be selected that has a photocatalytic effect by near-ultraviolet light or ultraviolet light. However, a photocatalytic reaction band (bandgap width) is different for each wavelength, hence a light source must be selected that can radiate light of a wavelength suitable for a certain photocatalytic material.

As disclosed in Japanese Laid-Open Patent Publication (Kokai) No. 2006-68683, a material having a photocatalytic effect by visible light can be used for a protection layer. Titanium oxide, which is also referred to as titanium dioxide, is formally white metallic oxide composed of titanium referred to as titanium oxide (IV) and oxygen.

In this embodiment, a transmission factor is an important element for a protection layer of the density sensor 111 through which light transmits. For example, a transmission faction-oriented photocatalytic film is disclosed in Japanese Laid-Open Patent Publication (Kokai) No. H11-348172.

This embodiment employs the fourth experiment example having a high transmission factor and antibacterial properties in Japanese Laid-Open Patent Publication (Kokai) No. H11-348172. Specifically, a photocatalytic film is comprised of a base layer of 20 μm thickness, a barrier layer of 1500 Å thickness evaporated on one surface of the base layer (evaporated layer), and a photocatalytic layer formed by coating the evaporated layer with photocatalytic coating liquid in gravure coating by 1 $g/m^2$. Lower values are preferable for antibacterial activity and adhesiveness. A smaller number of bacteria lead to a higher photocatalytic effect. Highly adhesive stains are difficult to be stripped even by cleaning by a service person.

A photocatalytic film used for the image forming apparatus is a photocatalytic film using:

base layer: polyethylene terephthalate, evaporated layer (barrier layer): aluminum, and photocatalytic layer: titanium oxide+silica (silica sol)

as main materials. It is preferable that the transmission factor of the photocatalytic film is preferably 90% or more.

Titanium oxide does not show superhydrophilicity being a photocatalytic effect if it is no longer under ultraviolet rays. On the contrary, silica shows the superhydrophilicity to a certain extent. Accordingly, this embodiment employs a mixture of titanium oxide and silica for a photocatalytic layer.

The above technique is also employed for coating on side mirrors of a car. The silica mixture shows an antifog effect even in night.

<Advantages of Photocatalytic Film>

Photocatalysis is known as being often employed not only for architecture and automobiles, but also for image forming apparatuses, and therefore detailed description thereof is omitted. Only a photocatalytic effect in this embodiment will be described. The photocatalytic film described above has the following features:

(1) decomposition of organic substances (2) superhydrophilicity

Accordingly, in this embodiment, it is possible to obtain the above two photocatalytic effects due to the photocatalytic film.

<Substances Adhering to Sensor in Image Forming Apparatus>

Substances adhering to the sensor include toners, silicone oil, wax, paper dust, grit, dust, for example. The toners, paper dust, grit, dust, etc. adhere to the sensor by static electricity, while the silicone oil fixes to the sensor through vaporized oil adhering to the cold sensor.

The toner adheres to the sensor by scattering in the apparatus. A main cause of the toner adherence is the static electricity, though the gravity being a molarity problem is also to be considered since the degree of stains changes depending on a direction of a sensor window.

Typically, the toner adherence can be avoided in consideration of the gravity if the sensor window is oriented downwards as much as possible. If the window must be oriented upwards due to a space for the image forming apparatus or a position for observation or if much toner scatters even for the downward window, a cleaning member or a shutter is provided for convenience.

The silicone oil is used for separation of a fuser and paper (toner) or for cleaning toner off the fuser. The toner contains wax, which is composed to keep the separating ability similarly to the silicone oil. Frequently, the silicone oil or wax vaporizes in the image forming apparatus, adheres to the sensor, is cooled and fixes to the sensor.

Silicone oil used in this embodiment is methyl phenyl polysiloxane, though organic oil such as dimethyl polysiloxane can be used. Wax is also an organic substance, of which details will be described later.

Paper dust floats such as from paper chipping (fiber fracture paper being cut in a pre-determined size). The floating paper dust adheres to the sensor.

Grit and dust adhere to the sensor window by the static electricity, while facilitating adhesion of toner and silicone oil. Particularly, silicone oil causes additional adhesion of grit and dust.

If the above substances adhere to the sensor, there occurs a shortage of light amount of the sensor. If the amount of received light changes, then a detected value varies in the detection of the same patch image, resulting in the variation in detected densities. This changes the maximum density (Dmax) to be controlled or gradation.

Toner contains organic substances and inorganic substances. Silicone oil, wax, and paper dust are organic substances. Grit and dust, which are difficult to be identified since they are not generated in the image forming apparatus, are organic substances in many cases.

This embodiment employs a roller charging method in which corona products such as NOx or ozone seldom generate, though a corona charging method can also be employed. In that case, in order to avoid influences of NOx or ozone, a photocatalytic material is used to decompose corona products as disclosed in Japanese Laid-Open Patent Publication (Kokai) No. 2006-251738, and a shutter is provided to prevent attaching of nitrate salt under high humidity, for example. A configuration is preferable such that nitrate salt (an inorganic substance generated by discharge products and water) does not adhere to a sensor.

NOx is an organic nitrogen compound. Photocatalysis has been actually used for an external wall of a tunnel to remove NOx. However, NOx reacts with water to form nitric acid or nitrate salt, changing to an inorganic substance. In that case, a photocatalytic effect is not obtained. Accordingly, it is preferable that gaseous body is guided immediately after electric discharge by air flow to collect discharge products by a filter.

<Physical Properties of Toner>

As described in material safety data sheets (MSDS) of manufacturers, components contained in toner and their weight percentages are as follows:

TABLE 1

| Toner color | Component | Organic/Inorganic | Weight percentage |
|---|---|---|---|
| Color toner (CMY) | Polyester resin | Organic | 80-90% |
| | Pigment | Organic | 5-10% |
| | Solid paraffin | Organic | 1-5% |
| | Amorphous silica | Inorganic | 1-2% |
| Black toner | Polyester resin | Organic | 80-90% |
| | Carbon black | Inorganic | 1-6% |
| | Solid paraffin | Organic | 1-5% |
| | Amorphous silica | Inorganic | 1-2% |

The table 1 shows an abstract of an MSDS of NPG-33 toner by a company C. As shown in the table, color toner and black toner both contain high weight percentage of polyester resin.

Polyester resin, which is referred to as biding resin, is composed to increase adhesiveness to paper and has the highest weight ratio.

As biding resin for toner according to this embodiment, the following can be used separately or by mixture: a homopolymer (1) of styrene such as polystyrene or polyvinyl toluene and its substitution product, a copolymer (2) such as a styrene-propylene copolymer or a styrene-vinyl toluene copolymer, and resin, etc. (3) described later.

As the above copolymer (2), the following can be used: a styrene-vinyl naphthalene copolymer, a styrene-acrylic acid methyl copolymer, a styrene-acrylic acid ethyl copolymer, a styrene-acrylic acid butyl copolymer, and a styrene-acrylic acid octyl copolymer.

Similarly, as the above copolymer (2), the following can be used: a styrene-acrylic acid dimethylamino ethyl copolymer, a styrene-methacrylic acid methyl copolymer, a styrene-methacrylic acid ethyl copolymer, and a styrene-methacrylic acid butyl copolymer.

Similarly, as the above copolymer (2), the following can be used: a styrene-methacrylic acid dimethylamino ethyl copolymer, a styrene-vinyl methyl ether copolymer, a styrene-vinyl ethyl ether copolymer, and a styrene-vinyl methyl ketone copolymer.

Similarly, as the above copolymer (2), the following can be used: a styrene copolymer such as a styrene-butadiene copolymer, a styrene-isoprene copolymer, a styrene-maleic acid copolymer, a styrene series copolymer such as a styrene-maleic acid ester copolymer, and polymethyl methacrylate.

As the above resin, etc. (3), the following can be used: polybutyl methacrylate, polyvinyl acetate, polyethylene, polypropylene, polyvinyl butyral, silicone resin, polyester resin, polyamido resin, and epoxy resin.

Also as the above resin, etc. (3), the following can be used: polyacrylic acid resin, rosin, denatured rosin, terpene resin, phenol resin, fatty series or alicyclic hydrocarbon resin, aromatic petroleum resin, paraffin wax, carnauba wax, for example. However, it is preferable that the above components are organic compounds for photocatalytic decomposition since their weight ratios contained in toner are high.

A pigment is a necessary material to develop colors. The following organic pigments are used separately or by mixture.

Color agents used in this embodiment are an inorganic carbon black substance as a black color agent, and organic pigments for yellow/magenta/cyan.

As typical pigments, the following can be used: organic pigments such as rhodamine lake, methyl violet lake, quinoline yellow lake, malachite green lake, alizarin lake, carmine 6B, lake red C, disazo yellow, or lake red 4R.

Similarly, organic pigments can be used such as chromophtal yellow 3G, chromophtal scarlet RN, nickel azo yellow, benzimidazolone azo, permanent orange HL, phthalocyanine blue, phthalocyanine green, or flavanthrone yellow.

Similarly, organic pigments can be used such as thioindigo bordeaux, perynone red, dioxazine violet, quinacridone red, naphthol yellow S, pigment green B, lumogen yellow, signal red, or alkali blue.

Similarly, organic pigments can be used such as aniline black, monoazo yellow, disazo yellow, carmine, quinacridone, rhodamine, or copper phthalocyanine.

For pigments used in toner, representative compounds such as a condensed azo compound, an isoindolinone compound, an anthraquinon compound, an azo metallic complex, a methine compound, and an allylamido compound are used as yellow color agents. Particularly, C.I. pigment yellow is often used.

As magenta color agents, a condensed azo compound, a diketopyrrolopyrrole compound, anthraquinon, a quinacridone compound, a basic dye lake compound, a naphthol compound, a benzimidazolone compound, a thioindigo compound and a perylene compound are used. Particularly, C.I. pigment red is often used.

As cyan color agents, a copper phthalocyanine compound and the derivatives, an anthraquinon compound, a basic dye lake compound, etc. can be used. Specifically, C.I. pigment blue is often used.

A black color agent, which is carbon black in the table, is an inorganic pigment to express an achromatic color. Considering reactivity with photocatalysis, aniline black or a color material can be mixed with a black organic pigment.

In the architecture industry, photocatalytic solution containing organic pigments is sprayed on a wall, for example, to prevent coating irregularity of photocatalysis. A color prevents coating irregularity, colored parts are naturally decomposed photocatalytically by the sun light, becoming transparent and colorless.

Carbon black is often used as a black color agent, though a magnetic material is also used. A magnetic material includes metallic oxide containing chemical elements such as iron, cobalt, nickel, copper, magnesium, manganese, aluminum, or silicon. However, they are inorganic substances, hence are not expected to be decomposed by photocatalysis.

Solid paraffin, which is so-called wax, is composed to keep separation from a fuser. Other wax such as hydrocarbon wax, wax having a functional group, or wax grafted with a vinyl monomer can be used, though it is preferable that an organic compound is used upon consideration of a photocatalytic reaction.

Hydrocarbon wax includes the following aliphatic hydrocarbon wax: low molecular weight polyethylene, low molecular weight polypropylene, a polyolefin copolymer, polyolefin wax, microcrystalline wax, paraffin wax, Fischer-Tropsch wax, etc.

The wax having a functional group includes: an oxide of aliphatic hydrocarbon wax such as oxidized polyethylene wax; its block copolymers; vegetable wax such as candelilla wax, carnauba wax, Japan wax, or jojoba wax; and beeswax.

Similarly, the above wax includes: animal wax such as lanolin or spermaceti wax; mineral wax such as ozokerite, ceresin, or petro lactam; and montanic acid ester wax.

Similarly, the above wax includes: waxes containing aliphatic ester as its main constituent such as castor wax; and deoxidization of part or all of aliphatic ester such as deoxidized carnauba wax.

Further, the above wax includes: long-chain saturated fatty acid such as palmitic acid, stearic acid, montanic acid, or long-chain alkyl carboxylic acid having a longer-chain alkyl group; unsaturated fatty acid such as brassidic acid, eleostearic acid, or parinaric acid; and stearyl alcohol.

Similarly, the above wax includes: eicosyl alcohol, behenyl alcohol, carnauba wax alcohol, seryl alcohol, and melissyl alcohol; saturated alcohol such as alkyl alcohol having a long-chain alkyl group; polyhydric alcohol such as sorbitol; aliphatic amido such as linoleamido, oleamide, or lauramido; and methylenebis stearic acid amide.

Similarly, the above wax includes: saturated aliphatic bisamide such as ethylenebis capric acid amide, ethylenebis lauramido or hexamethylenebis stearic acid amide; and ethylenebis oleamide and hexamethylenebis oleamide.

Similarly, the above wax includes: unsaturated fatty acid amides such as N,N'-dioleyl adipic acid amide or N,N'-dioleyl sebacamide; and m-xylene bisstearic acid amide.

Similarly, the above wax includes: aromatic bisamide such as N,N'-distearyl isophthalic acid amide; and stearic acid calcium, calcium laurate, and zinc stearate.

Similarly, the above wax includes a methyl ester compound having a hydroxyl group. The compound is obtained by hydrogenating: aliphatic metallic salt (generally referred to as metal soap) such as stearic acid magnesium; a partial ester compound of aliphaic acid such as behenic acid monoglyceride and polyhydric alcohol; and vegetable oil.

Wax grafted with a vinyl monomer includes wax grafted with a vinyl monomer such as styrene or acrylic acid to aliphatic hydrocarbon wax.

Amorphous silica is an adjuvant to set electric charge of toner referred to as a charging control agent to a pre-determined value. In addition to silica, a metallic element such as an aluminum chemical element can be contained. An adjuvant is basically an inorganic compound, and is not decomposed photocatalytically.

<Substances Decomposed by Photocatalys>

Materials that can be decomposed by photocatalytic reactions are organic substances (organic compounds) only. An organic substance is a compound containing C (carbon) as its component or a substance causing an oxidation-reduction reaction. However, a carbon compound such as carbon monoxide or carbon dioxide and a simple compound such as carbonate are not classified as the organic substances. Accordingly, carbon black is "C" in a molecular formula and is an inorganic substance.

Rates of the inorganic substances (carbon black and hyaline silica, for example) contained in toner in the table 1 are 1 to 8%. Other organic materials can be decomposed. Therefore, most of 90% or more of the weight contained in toner, silicone oil, paper dust, grit, and dust can be decomposed by photocatalyst.

The photocatalytic decomposition means oxidation-reduction reaction, in which titanium oxide irradiated with ultraviolet rays absorbs electronic ultraviolet rays in titanium oxide crystal. In the reaction, a photon collides against an electron in the titanium oxide crystal and excites (electron having negative electric charge). A hole having positive electric charge is also generated.

When an oxygen molecule is absorbed on the surface of titanium oxide, the excited electron having negative electric charge (e−) or the hole (h+) reacts with the oxygen (reduction reaction of oxygen):

$$O_2+e^- \rightarrow O_2^-$$

Next, the result reacts with a hole (oxidation reaction):

$$O_2^-+h^+ \rightarrow 2O$$

The generated oxygen atom O reacts with another excited electron having negative electric charge (e−):

$$O+e^- \rightarrow O^- \text{ (atomic oxygen)}$$

Further, the atomic oxygen reacts with oxygen in the air:

$$O^-+O_2 \rightarrow O_3^-$$

The above $O^-$, $O_2^-$ and $O_3^-$ are referred to as active oxygen species, very unstable, and tend to cause chemical reactions. The above feature is referred to as strong oxidizability. The oxidizability decomposes organic substances, eventually into inorganic substances.

Among undesired substances adhering to the sensor in the image forming apparatus, 90% or more of toner, silicone oil, paper dust, grit, dust, etc. are organic substances, hence they are eventually decomposed into inorganic substances such as $H_2O$ and $CO_2$. Polyester resin (herein, polyethylene terephthalate) that most contains toner is known to be obtained by polycondensation of terephthalic acid and ethylene glycol.

The resin is represented as follows in a molecular formula, from which it can be understood that the resin is an organic substance.

[Formula 1]

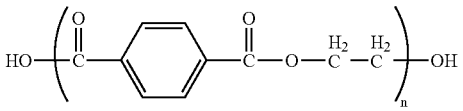

To predict time required to actual photocatalytic reaction (decomposition), it is necessary to precisely know parameters such as the amount of photons, the wavelength of light, a bandgap of photocatalyst, the area ratio of photocatalyst on the surface of a film, details of stains components (a molecular formula, molarity, a form, a surface feature), or an adhesion area. However, it is almost impossible to precisely know the parameters.

Even if the above parameters can be known, it is difficult to predict reaction time precisely since quantum use efficiency varies depending on usage environments as in the case in that a substance is not used for a reaction due to recombination with another hole immediately after excitation.

Accordingly, many conventional test methods for a photocatalytic film or a coating agent use relative comparison or experiment results to describe the effects. In this embodiment, a sensor coated by a photocatalyst and a sensor not coated by a photocatalyst are compared for experiment.

<Preparation of Verification: Light Source>

It is difficult to predict precise decomposition time. However, to increase the use efficiency using titanium oxide, much light of a wavelength suitable to a bandgap should be radiated to titanium oxide. Much light means that radiant flux (watt) is high. It is important to increase the light density and give photons to much titanium oxide.

Based on the above, first a round-type LED (NSHU590B) being a UV LED by Nichia Corporation is used upon consideration of the wavelength. Light sources of many sensors employ the above round-type infrared light or white light LEDs, which is employed in this embodiment. The round type is convenient partly because it spreads less light and increases light flux.

The above UV LED (NSHU590B) has the peak wavelength of 365 nm and the half-width spectral value of 10 nm. It has the peak around a wavelength range (387.5 nm or less) enough to excite titanium oxide.

Radiant quantity (for example, W: watt) and luminous quantity (for example, lm: lumen) express light strength features. The luminous quantity is basically an expression method in a visible region, so this embodiment employs expression in radiant quantity.

LED standard specifications of UV LED (NSHU590B) by Nichia Corporation specifies from 1000 to 2000 μW, i.e., radiant quantity from 1.0 to 2.0 mW (0.001 to 0.002 W).

Upon consideration of that a change of an irradiate angle by five degrees decreases the amount of light by about 40%, radiant quantity on the irradiated surface can be assumed to be about 1.1 mW/cm$^2$ (calculated using the radiant quantity of 1.5 mW being the center value and the radiant quantity per a unit area of 75% of the peak).

The value 1.1 mW/cm$^2$ (square cm: second power of cm, the same hereinafter) means that 2.2×10^15 (fifteenth power of ten, the same hereinafter) photons are irradiated per 1 cm$^2$ and one second. To figure out the precise number of photons, the two-dimensional photon spectral measurement apparatus PMA-100 by Hamamatsu Photonics K.K. can be used, for example.

The radiant quantity of ultraviolet rays contained in the sun light is about 3 mW/cm$^2$ while the radiant quantity of ultraviolet rays from fluorescent is about 0.01 mW/cm$^2$. Accordingly, the ultraviolet ray radiant quantity from the above UV LED is about ⅓ of the sun light and about 110 times of that from fluorescent. As such, the UV LED has enough photocatalytic resolution and self-cleaning as generally known.

Figure 7:
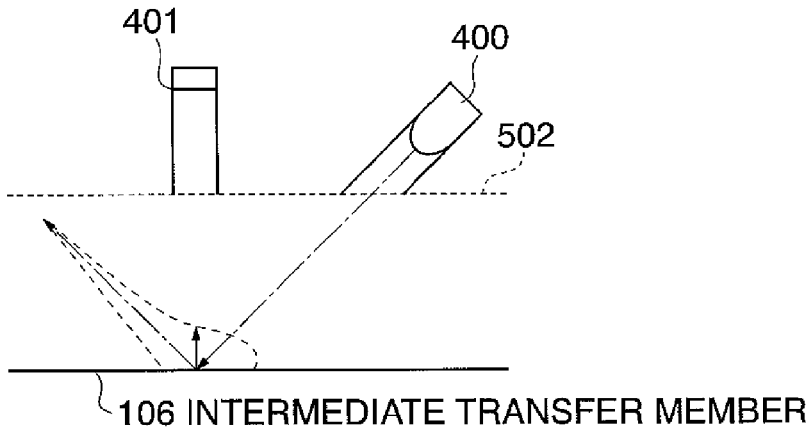
FIG. 7 is a diagram schematically showing reflection characteristics of ultraviolet rays radiated to an intermediate transfer member in the density sensor in FIG. 5.

To achieve photocatalytic effects, many ultraviolet rays must be radiated on titanium oxide. FIG. 7 is a diagram schematically showing reflection characteristics of ultraviolet rays radiated to an intermediate transfer member in the density sensor in FIG. 5.

In FIG. 7, arrows and a part surrounded by dotted lines indicate distribution of reflected light. As shown, the window of the light emitting unit 400 receives enough irradiated UV LED light, and hence a photocatalytic reaction can be expected. However, the light receiving unit 401 receives very little light. Toner scatters and various types of stains adhere irrespective of the position of a window, so it is important how to provide strong ultraviolet rays to the window of the light receiving unit 401.

As shown in FIG. 7, a rough surface such as the intermediate transfer member 106 contains many diffusing components and loses much normally reflected light. To reduce diffusely reflected light as much as possible and cause total reflection in the regularly reflecting direction, a mirror is used advantageously.

A mirror having a smooth surface and realizing metallic total reflection should lose less normally reflected light. Accordingly in this embodiment, the mirror shutter 404 is arranged at such a position that the UV LED as shown in FIG. 6 can radiate light to provide an image on the window of the light receiving unit 401.

<Verification: Endurance Test>

As the density sensor 111, two kinds of sensors are prepared. The two kinds of sensors only have the difference in configuration of protection sheets: one of the protection sheets is configured in the above photocatalytic film, while the other is configured only in polyethylene terephthalate being the base material of the above photocatalytic film (the protection sheet is not a photocatalytic film). The two sensors are arranged side by side in the center of in the main scanning direction for experiment. For each of the two kinds of sensors, a cleaning member is equipped on the shutter 404.

The LED light amount control unit 402 controls a power voltage applied to an LED such that a detected value of the light receiving unit 401 is a certain value (for example, 1.5 V) when the base intermediate transfer member 106 is irradiated with light.

Figure 8:
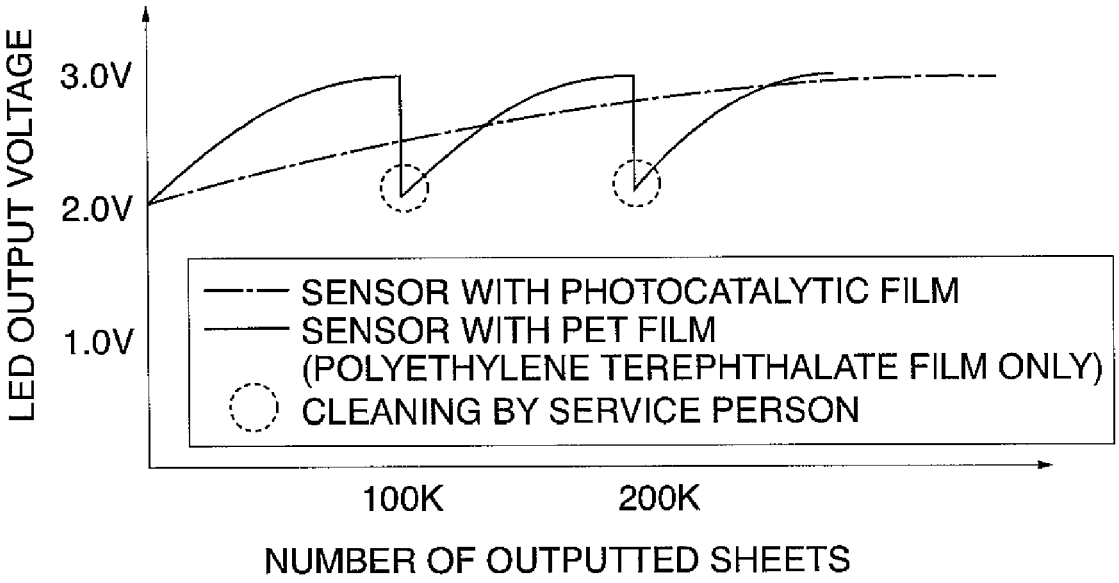
FIG. 8 is a diagram showing the relationship between an LED output voltage of the density sensor in FIG. 4 and the number of sheets outputted by the image forming apparatus.

FIG. 8 is a diagram showing the relationship between an LED output voltage of the density sensor in FIG. 4 and the number of sheets outputted by the image forming apparatus.

In FIG. 8, initially, the amount of LED light (LED output voltage) for a detected value 1.5 V of the light receiving unit 401 is 2.0 V. For any of the two kinds of sensors, as the number of outputted sheets (K) of the image forming apparatus increases, the amount of LED light (V) also increases accordingly.

In this embodiment, the upper limit is defined to be 3.0 V upon consideration of rating, stains and the density calculation accuracy of an LED. In a sensor with a PET film (the solid line in FIG. 8), points surrounded by dotted line circles in FIG. 8 indicate when a service person cleaned (wiped with ethanol) the sensor since the LED has exceeded a pre-determined value. The cleaning is normally performed by a service person regularly or when a sensor error occurs.

Even if the density sensor 111 is cleaned, the density sensor 111 and the intermediate transfer member 106 may have stains or scratches that cannot be removed by the cleaning member. Accordingly, the amount of LED light seldom returns to the initial value (the amount of LED light for 0 K).

On the other hand, for the sensor with the photocatalytic film, the increase rate of the amount of LED light is lower than that of the sensor with the PET film, as shown in a graph of a single dashed line in FIG. 8. As such, sensor cleaning by a service person is unnecessary up to approximately 300 K.

To eliminate a cause of temporal change of the intermediate transfer member 106, the position of the density sensor 111 is changed and similar measurement is performed as the above. The amount of LED light transits to about a value as the above. This indicates that stains of the density sensor 111 are the main cause of LED output voltage variation shown in FIG. 8.

Based on the above result, by employing a photocatalytic film for the film of the density sensor 111, and irradiating the photocatalytic film with ultraviolet rays of the UV LED for a predetermined time period, the decrease of sensor output can be reduced and an time interval for cleaning by a service person can be lengthened.

<Use of Superhydrophilicity Effects>

A photocatalytic film is not universal. The light amount of the sensor is unstable at the initial value 1.5 V partly because the resolution is not sufficient for stains. Further, since each sensor is provided with the cleaning member (equipped on the shutter 404), stains such as silicone oil that cannot be completely removed by the cleaning member might adhere to the sensor. Conventionally, such stains are removed using ethanol. However, white turbidity is a problem for weak chemical-resistant sensor parts or protection parts. Accordingly, a user and a service person desire water cleaning.

It is known that photocatalyst has strong oxidation resolution and superhydrophilicity. Superhydrophilicity, which is referred to as an optical solid surface reaction, occurs due to change of properties of a titanium oxide surface depending on radiated light.

When ultraviolet rays are radiated, a hydrophilic domain (micro region) is formed on a portion of a uniform hydrophobic surface. As disclosed such as in Japanese Laid-Open Patent Publication (Kokai) No. 2002-234105, a domain of several tens nm can be observed on the surface using an atomic force microscope.

An image appearing on an atomic force microscope represents the difference of the frictional force between a small needle and a surface as an image. In such a state, the capillary force (the force acting on a microscopic aperture of a solid by surface tension of liquid) acts and hydrophilicity increases. A hole produced by irradiated light oxidizes oxygen constituting titanium oxide crystal, resulting in the defect of oxygen and water absorbing on the oxygen defecting portion.

As one representative example of the capillary force includes the case of a glass capillary tube. When a glass capillary tube is stood on the surface of the water statically, water ascends in the tube to a certain height.

Irradiation of titanium oxide with ultra violet light forms a domain. A micro domain produces the capillary force, resulting high hydrophilicity.

The superhydrophilicity is used to remove adhered stains only with water without using chemicals such as ethanol even if the amount of attaching stains exceeds the oxidation resolution. For example, a so-called cotton bud being wet with water is used to wipe the sensor surface. Strong oxidizing resolution can decompose organic substances, and the superhydrophilicity can suspend stains.

Describing in order, first, the cleaning member equipped on the shutter 404 removes large stains. Second, photocatalytic oxidizability decomposes adhered organic substances to decrease the adhesion, and the cleaning member removes the substances. Third, the superhydrophilicity removes stains that could not be removed by the second processing.

The sensor cleaning is performed in the three stages described above. The third processing is cleaning by a service person. Stain deterring effects are about three times more than the case in that a photocatalytic film is not used. Since stains can be removed without using ethanol, a cleaning method can be established that is free from adverse effects such as white turbidity of weak chemical-resistant parts.

<Timing>

Figure 9:
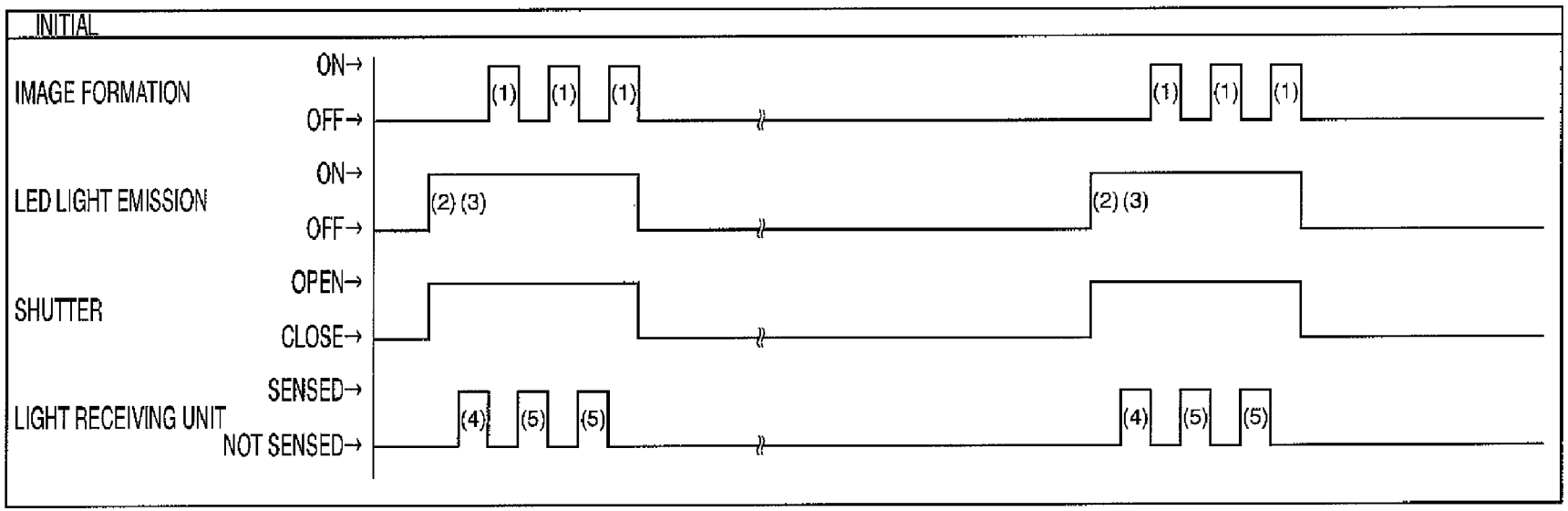
FIG. 9 is a timing chart of normal successive image forming operation at the beginning and successive image forming operation after a predetermined time period in the image forming apparatus in FIG. 1.

FIG. 9 is a timing chart of normal successive image forming operation at the beginning and successive image forming operation after a predetermined time period in the image forming apparatus in FIG. 1.

In FIG. 9, "image formation" schematically indicates the timing of forming an image of a size A3, in which an image with four colors of CMYK is formed at one peak in an ON part. In this embodiment, the three peaks in the drawing indicate that three images are formed.

The "LED light emission" indicates timing when the light emitting unit 400 makes a LED emit light. A section (2) is a period to wait for the LED to be stable, and a section (3) is a period to adjust the amount of LED light. The section (3) is to change the amount of light (power voltage) such that a detected value during a section (4) for detection by the light receiving unit 401 is a pre-determined value. After the section (3), the amount of light controlled during the section (2) is used to continue the emission.

The "shutter" indicates open/close of the shutter 404. At the initial time, the shutter is linked to the LED light emission. That is, when the shutter 404 opens, the light emitting unit 400 emits LED, and when the shutter 404 closes, the light emitting unit 400 turns out the LED.

The "light receiving unit" indicates timing of detection by the light receiving unit 401. The section (4) is a period to detect the base of the intermediate transfer member 106 for adjustment of the amount of LED light. A section (5) is a period to detect a patch image printed on paper and feed back the image to the γLUT.

As in the above flow of adjustment of the amount of LED light, the base of the intermediate transfer member 106 is scanned to change the amount of LED light to be a predetermined value.

Figure 10:
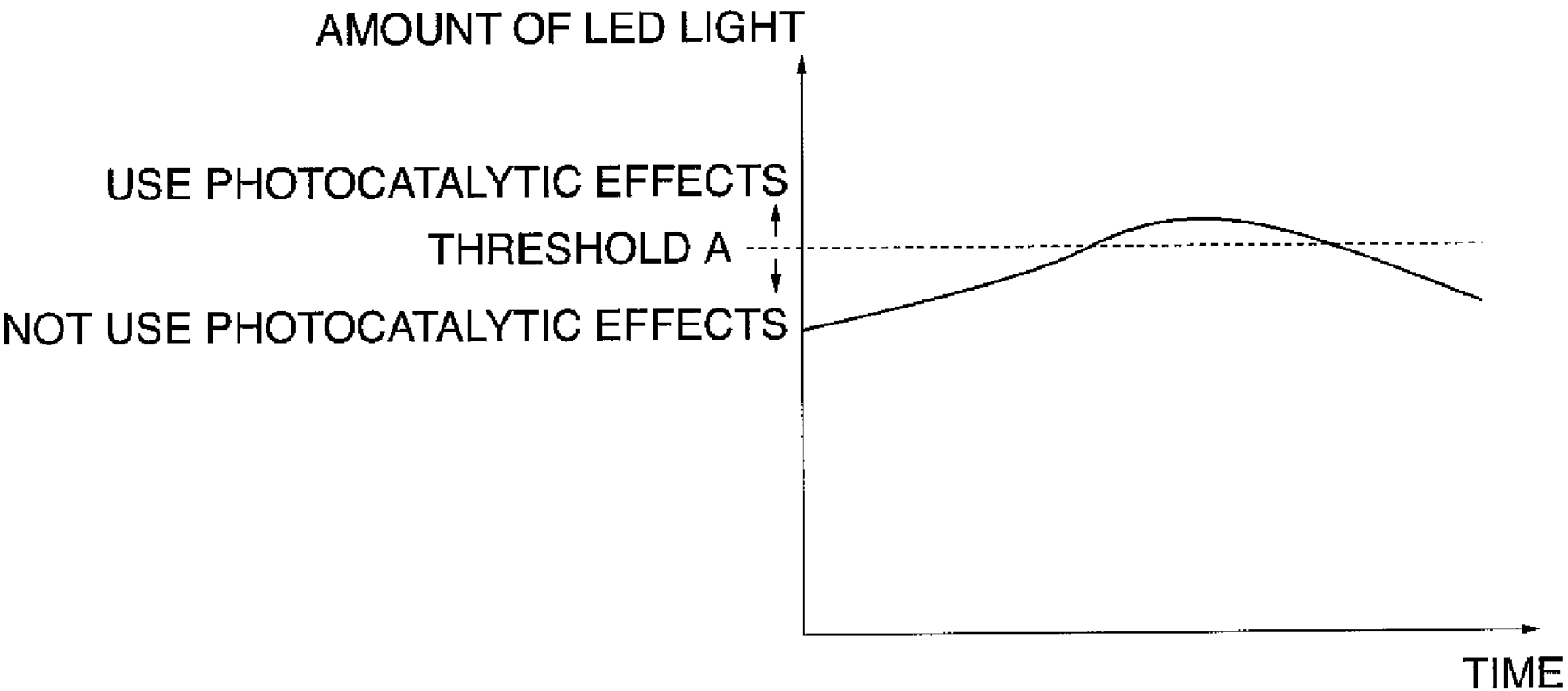
FIG. 10 is a diagram showing the relationship between the amount of LED light of the density sensor in FIG. 4 and time.

FIG. 10 is a diagram showing the relationship between the amount of LED light of the density sensor in FIG. 4 and time.

As shown in FIG. 10, when the sensor window gets stains, a detected value decreases, and hence the amount of LED light increases (the right-up portion in the left of the graph). Accordingly, if the amount of light exceeds a threshold A, the photocatalytic effects are actively used by control.

Figure 11:
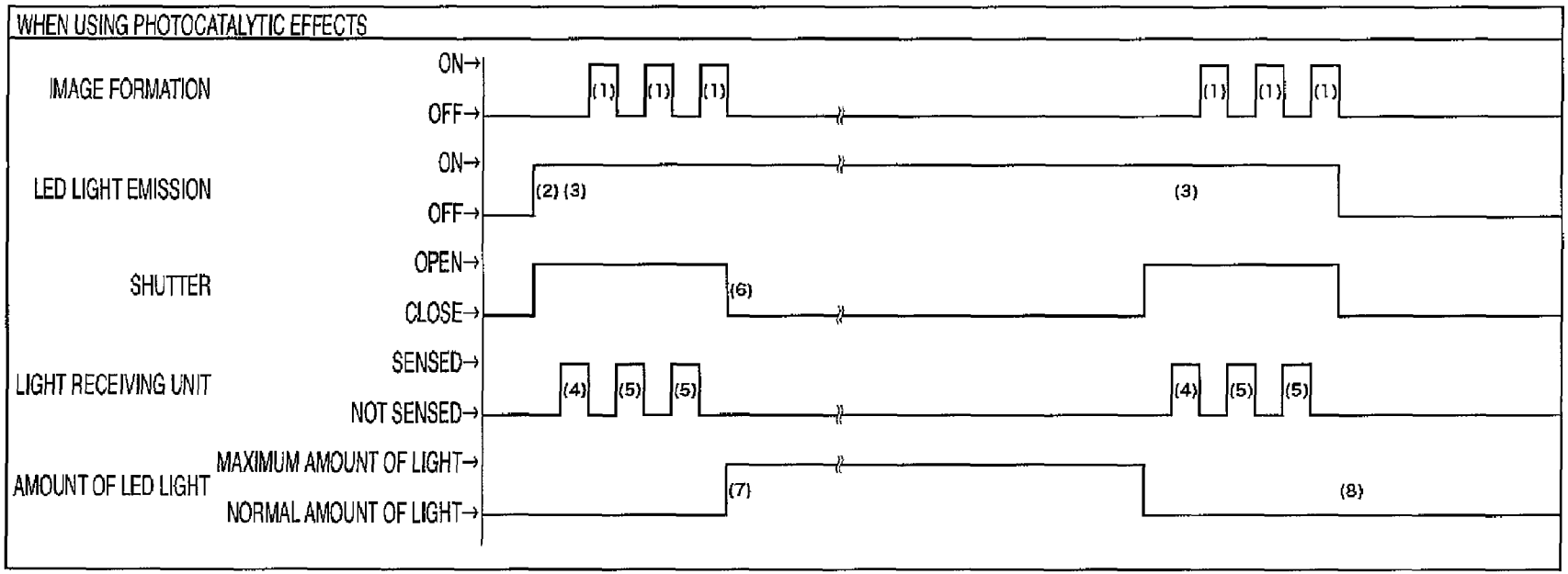
FIG. 11 is a timing chart of the initial successive image forming operation and the successive image forming operation after a predetermined time period while the image forming apparatus in FIG. 1 uses the photocatalytic effect.

FIG. 11 is a timing chart of the initial successive image forming operation and the successive image forming operation after a predetermined time period while the image forming apparatus in FIG. 1 uses the photocatalytic effects.

FIG. 11 clearly shows the change in the initial sequence shown in FIG. 9. As shown, the LED light emission is performed irrespective of that the shutter 404 is closed. A section (6) from closure of the shutter 404 to opening of the shutter 404 is to actively use the photocatalytic effects.

If the amount of light suitable to the base detected during section (4) exceeds the threshold A, the LED is also made emit light during the section (6). As shown in a section (7), the maximum amount of LED light is emitted during the section (6) to use the photocatalytic effects in this embodiment.

After the predetermined time period (the portion shown in the right of FIG. 11), if the amount of light is less than the threshold A in the section (4), the operation returns to the initial operation not using the photocatalytic effects. The amount of LED light is set to the normal amount of light as shown in a section (8).

As described in the above, in the image forming apparatus using a photocatalytic film to prevent stains on the density sensor 111, the shutter 404 is arranged at a position where normally reflected light provides an image on the window of the light receiving unit 401. The light emitting unit 400 makes LED emit light of a wavelength range adapted to the bandgap width of the photocatalytic film constituting the protection sheet 502, and the light receiving unit 401 is sensitive in the wavelength range of the light of the LED emitted from the light emitting unit 400, hence time to decompose stains and time to remove stains can be shortened. Accordingly, a photocatalytic film and its use efficiency thereof can be improved, substances that cannot be completely removed with a cleaning member are decomposed or not adhered, to thereby make it possible to decrease the failure rate of the image forming apparatus.

During the photocatalytic reaction while the shutter 404 is closed, the amount of light (radiant quantity) can be set higher than that in normal density control, further shortening stain decomposing time and stain removal time.

Variation 1 of First Embodiment

In the first embodiment, the shutter 404 is equipped with a mirror for a photocatalytic reaction upon consideration of stains on the light receiving unit 401. However, the shutter 404 might not be provided because of problems of installation space and cost.

Even if the shutter 404 or a mirror cannot be arranged, a photocatalytic film or coating can be provided on the protection sheet 502. By irradiating the film or coating with ultraviolet rays, the photocatalytic reaction decomposes and prevents stains on the window of the light emitting unit 400. Therefore, even if the shutter 404 is not provided in the first embodiment, half of stains adhering to the sensor can be prevented. This decreases the frequency of cleaning by a service person, solving the problem of the present invention.

However, in the configuration of the variation 1, the wavelength range of light emission by the light emitting unit 400, the bandgap width of a photocatalyst, and the wavelength range of sensitivity of the light receiving unit must be adapted, as described in the above embodiment.

Variation 2 of First Embodiment

To solve the problem of an installation space described in relation to the above variation 1, a film-type covering part can be used instead of a metal shutter. In many cases, a film-type covering part cannot image normally reflected light on the window of the light receiving unit 401 due to its curving or twisting.

Using such a covering material, a white diffuse reflector transmits light to the light receiving unit 401 than a specular reflector. A specular reflector suffers from deviation of the angle of a reflecting surface. As such, the use of a white diffuse reflector as a film-type covering part serves to reserve the amount of light received by the light receiving unit 401.

Even if normally reflected light cannot be guided to the window of the light receiving unit due to an installation space, it is effective to use a white diffuse reflector as a shutter. The amount of received light is lower than normally reflected light, but the light receiving unit can be irradiated with ultraviolet rays, achieving the photocatalytic effects.

It is to be noted that a white diffusion film must be employed that does not absorb light of ultraviolet rays (around 387 nm). Since diffused light enters the light receiving unit, a color such as black to absorb ultraviolet rays decreases the use efficiency of the photocatalytic effects.

Variation 3 of First Embodiment

In the first embodiment, the detection result of the light receiving unit 401 is used to determine whether or not ultraviolet rays should be radiated while the shutter 404 is closed. Since the photocatalytic effects cannot be achieved at instance, LED radiation can be continued. The increase of the temperature of LED is lower than that of other light sources. However, it is important to employ LED not to influence neighbor parts and not to cause a problem of accumulated emission time of LED.

Variation 4 of First Embodiment

As described in relation to the variation 1, radiation of UV LED under the threshold A retains superhydrophilicity, hence is effective to prevent stains. Upon consideration of a problem of the life (in years) of the apparatus and the life of LED, LED radiation is executed in a low-power mode (also referred to as a sleep mode) executed when the main power supply is switched off or when no input job is received for a predetermined time period, achieving a high stain prevention effect.

Variation 5 of First Embodiment

Continuous LED radiation achieves the high stain prevention effect. However, a user might unplug the image forming apparatus to restrain the standby electricity. Typically, the unplugged apparatus cannot radiate LED. However, an electrical storage unit referred to as a capacitor can turn on LED of the unplugged apparatus, as disclosed in Japanese Laid-Open Patent Publication (Kokai) No. 2006-262681, for example.

UV LED in the first embodiment is about power voltage 3.6 V and electric current 20 mA. As such, if a resistance is provided to adjust the power voltage, a plurality of normal batteries (including a charging type) being connected can apply to that.

Figure 12:
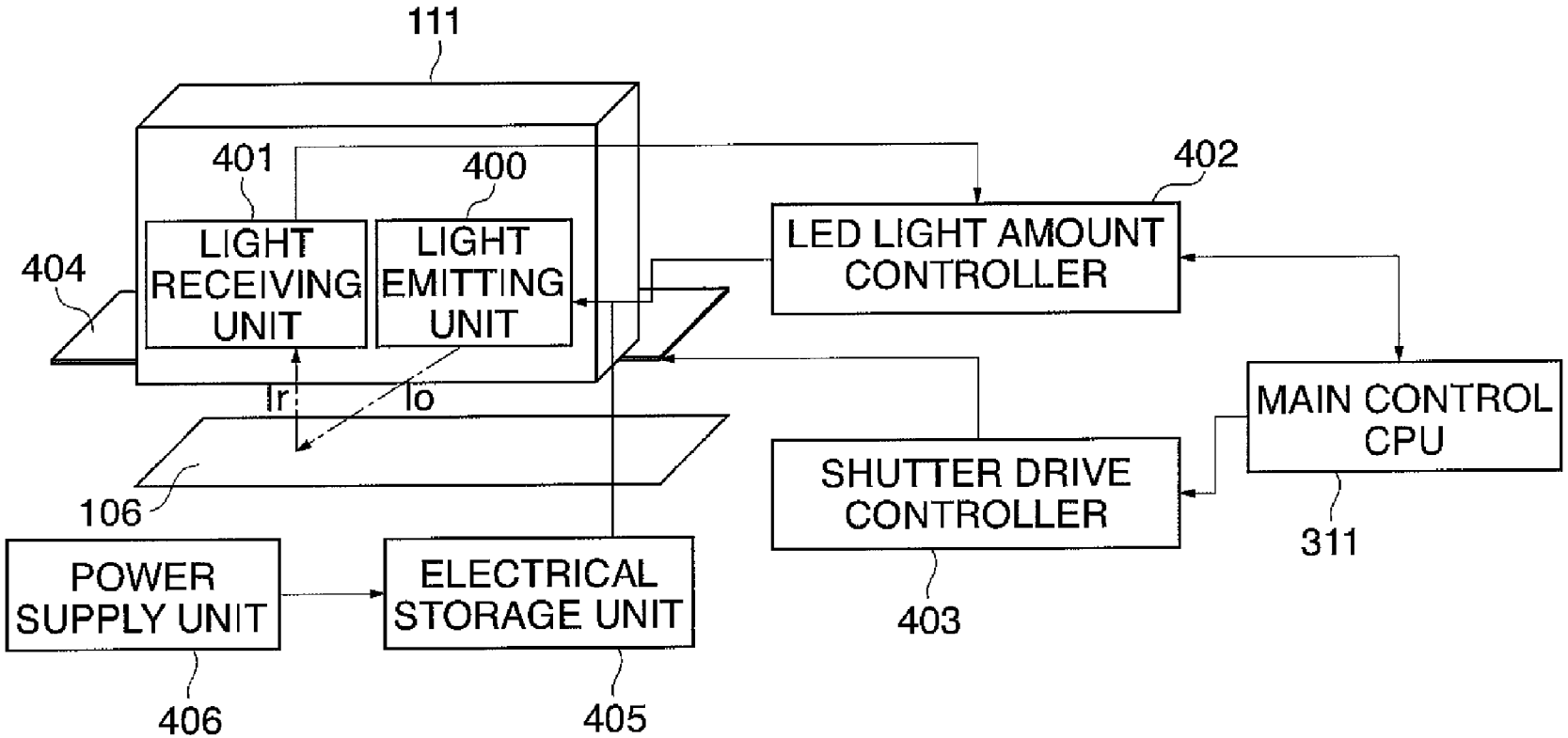
FIG. 12 is a block diagram showing a variation 5 of the density sensor in FIG. 4 and the related units.

FIG. 12 is a block diagram showing a variation 5 of the density sensor in FIG. 4 and the related units.

In the configuration shown in FIG. 12, an electrical storage unit 405 and a power supply unit 406 are added to the configuration shown in FIG. 4. The electrical storage unit 405 is gradually charged by the power supply unit 406 during normal image formation.

The image forming apparatus that has finished image forming operation closes the shutter 404. Afterward, a user turns off the power supply of and unplugs the image forming apparatus. Upon detection of the unplug of the electric current sensor provided in the power supply unit 406, i.e., the stop of power supply to the image forming apparatus, electric charge charged for the electrical storage unit 405 is released.

A technique to detect unplug includes techniques disclosed in Japanese Laid-Open Patent Publication (Kokai) No. 2005-210823 and Japanese Laid-Open Utility Model Publication (Kokai) 5-8470, for example. The techniques are useful to the detection. The power supply unit 406 being plugged stops release of electric charge that is charged for the electrical storage unit 405. Afterward, operation switches to normal control by the main control CPU 311.

Second Embodiment

Figure 13:
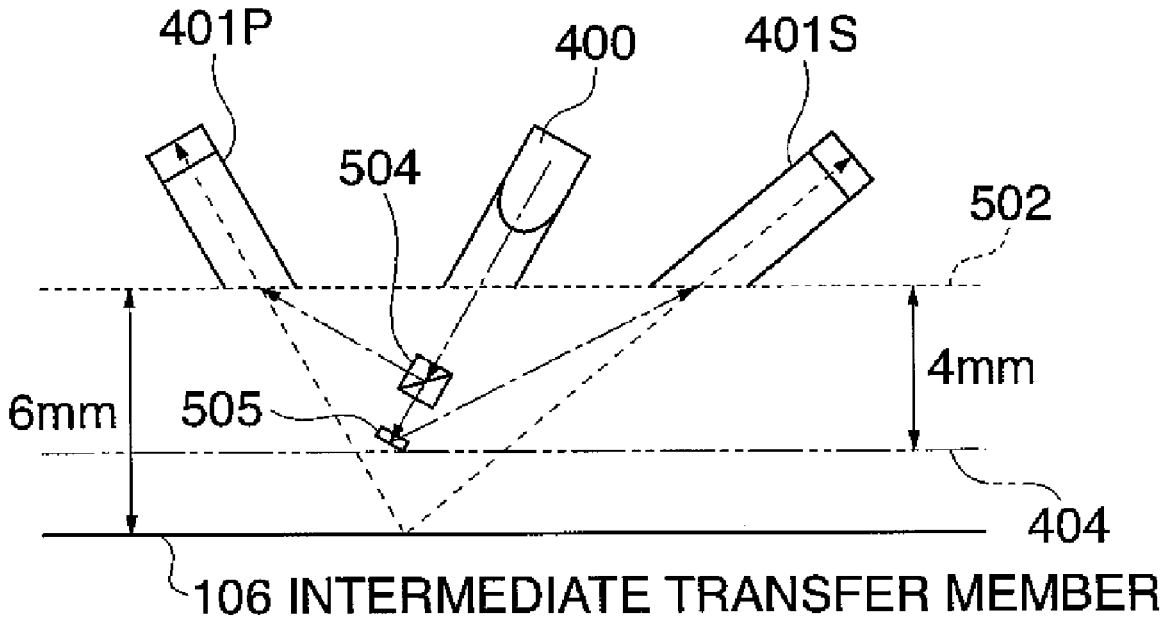
FIG. 13 is a diagram showing a density sensor of an image forming apparatus according to a second embodiment of the present invention.

FIG. 13 is a layout diagram showing a density sensor of an image forming apparatus according to a second embodiment of the present invention.

This embodiment will be described using a single-emission/double-reception (two-window) type sensor as shown in FIG. 13. Many sensors like this are used in the image forming apparatus. An optical configuration to facilitate the photocatalytic effects in the sensor will be described.

As shown in FIG. 13, the light receiving unit 401 includes a light receiving unit 401P for receiving normally reflected light and a light receiving unit 401S for receiving diffusely reflected light. Basically, normally reflected light only travels in one direction. As such, the two-window type sensor needs to divide incoming light into two pieces. For this purpose, a divider 504 is provided for dividing light from the light emitting unit 400 into two directions in this embodiment.

As the divider 504, a well known cubic beam splitter is generally used. Light that has entered the divider 504 is divided into a direction in which the incoming light transmits and a direction of 90 degrees to the transmitted light at rate 1:1. A mirror 505, which is arranged on the back of the divider 504 for the light emitting unit 400, guides the light that has transmitted to the divider 504 to a window of the light receiving unit 401S. The mirror 505 can be a prismatic half mirror upon consideration of an arrangement space.

As described in the above, also in the double-reception type density sensor 111, a divider such as a half mirror or beam splitter can divide light such that normally reflected light is radiated to the windows of the respective light receiving units. As such, when stains are detected or the shutter 404 is closed, a problem of detected values of the sensor due to the stains can be resolved by utilizing the photocatalytic effects also in this embodiment similarly to the first embodiment.

It is needless to say that the above half mirror and beam splitter use materials not to filter out ultraviolet rays.

Variation of Second Embodiment

The second embodiment has been described by referring to a beam splitter. A half mirror might actually decrease the initial amount of light because of light division.

Assume that one of the light receiving units 401P and 401S in FIG. 13 has stains. For example, if the light receiving unit 401P varies from the initial state larger than the unit 401S when the identical base is detected, this means that the window of the light receiving unit 401P has stains.

Assuming the above case, a half mirror can be changed to a mirror. However, in that case, a driving device (for example, a solenoid) needs to be prepared for moving a mirror back and forth to reflect light on the light receiving unit 401P on the light axis.

Third Embodiment

In this embodiment, a simple configuration is illustrated so as not to increase the cost of the sensor.

Figure 14A:
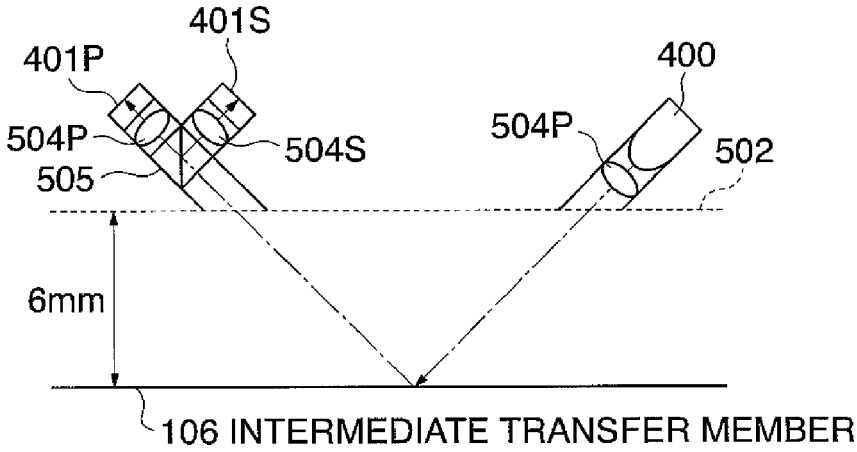
FIG. 14A is a diagram of the optical configuration of a density sensor of an image forming apparatus according to a third embodiment of the present invention in its normal operation.
Figure 14B:
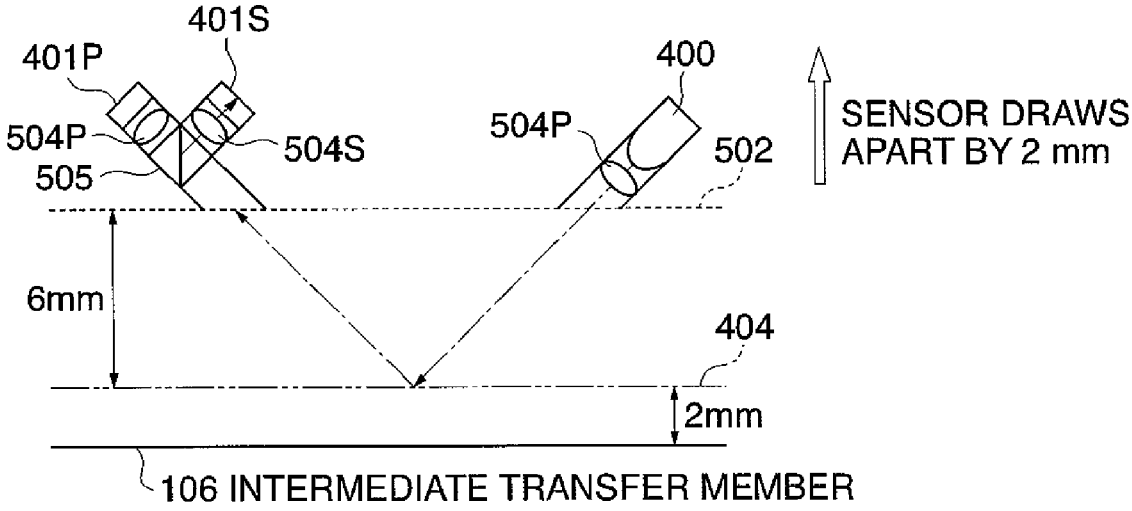
FIG. 14B is a diagram of the optical configuration of the density sensor of the image forming apparatus according to the third embodiment while the shutter is closed.

FIG. 14A is a diagram of the optical configuration of a density sensor of an image forming apparatus according to a third embodiment of the present invention in its normal operation; and FIG. 14B is a diagram of the optical configuration of the density sensor of the image forming apparatus according to the third embodiment while the shutter is closed.

FIG. 14 shows a single-emission/single-reception type density sensor different from the first embodiment.

Ultraviolet rays radiated from the light emitting unit 400 passes a single-direction wave through a polarizing plate 504P. The ultraviolet rays that have passed through the polarizing plate 504P irradiate the intermediate transfer member 106, reflect on a toner image such as a patch or the surface of the intermediate transfer member 106, and enter the light receiving unit 401.

The light receiving unit 401 is provided with a the half mirror 505, the polarizing plate 504P which light normally reflected on the half mirror 505 enters, and the light receiving unit 401P for receiving light that has passed through the polarizing plate 504P. The unit 401S is also provided with a polarizing plate 504S which light diffusely reflected on the half mirror 505 enters and the light receiving unit 401S for receiving light that has passed through the polarizing plate 504S.

In a density sensor having such a configuration, the light receiving unit 401 is arranged at the position from which normally reflected light enters. As such, the photocatalytic mirror shutter 404 must be arranged at the position of 6 mm.

Therefore, the density sensor is moved in a direction apart from the intermediate transfer member by 2 mm as shown in FIG. 14B. Specifically, the shutter 404 is arranged at the focus distance, i.e. a position apart from the density sensor by 6 mm, and the entire density sensor 111 is moved upwards by 2 mm when the shutter 404 is closed.

Figure 15:
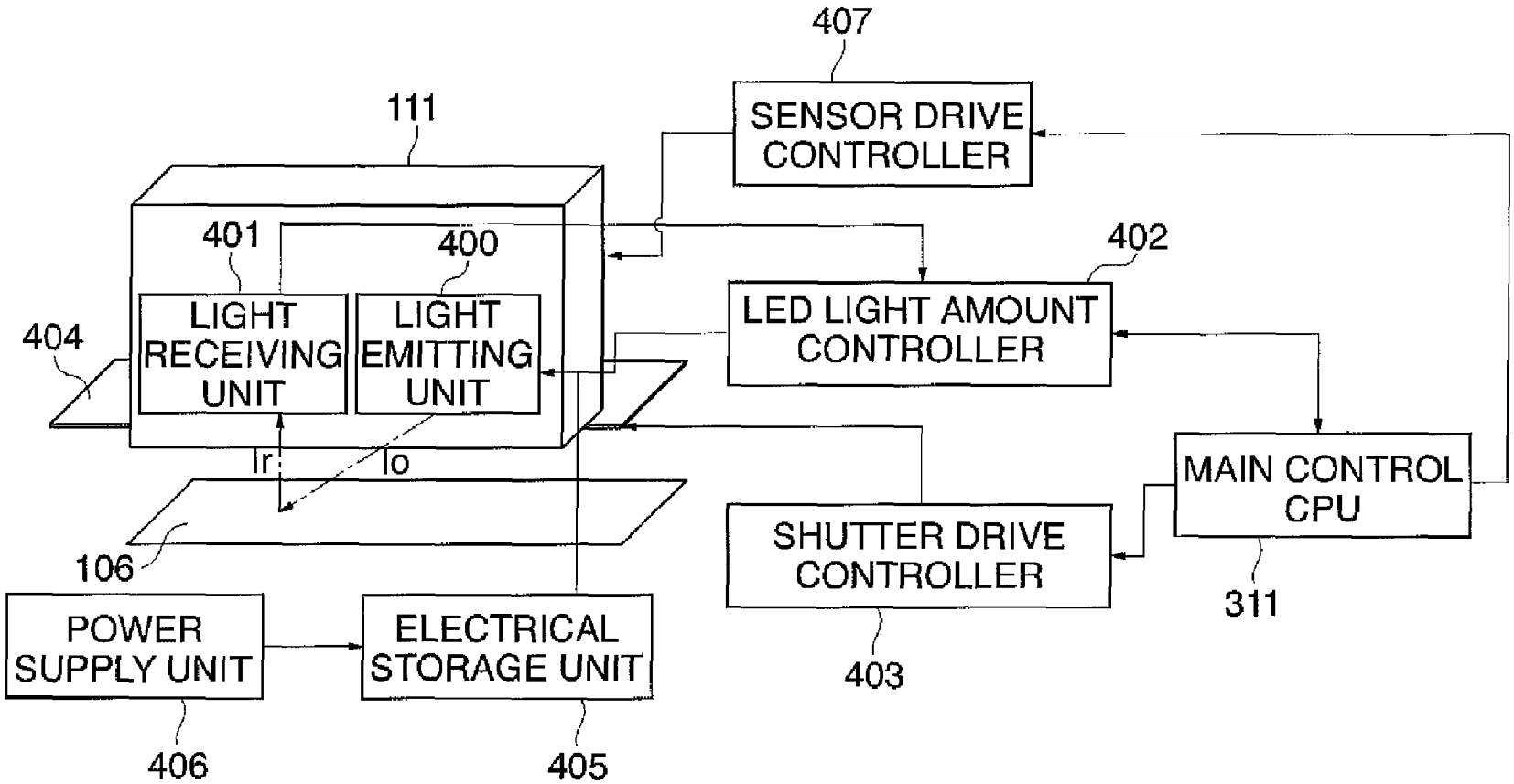
FIG. 15 is a block diagram showing the density sensor according to the third embodiment and the related units.

FIG. 15 is a block diagram showing the density sensor according to the third embodiment and the related units.

In the configuration shown in FIG. 15, a sensor drive control unit 407 for controlling a driving apparatus (not shown) for moving the density sensor 111 is added to the configuration shown in FIG. 12. The sensor drive control unit 407 is controlled by the main control CPU 311.

The sensor drive control unit 407 is provided for moving the density sensor 111 by 2 mm such that the shutter 404 does not contact the intermediate transfer member 106. The timing to open/close the shutter 404 is important: to close the shutter 404, operation to move the sensor by 2 mm and then close the shutter 404 is executed. On the contrary, to open the shutter 404, it is important to open the shutter 404 first, and then return the density sensor to the original position. If the operation is not performed in the above order, the shutter 404 may contact the intermediate transfer member 106.

Fourth Embodiment

In this embodiment, the density sensor described in the third embodiment is used to irradiate the window of the light receiving unit with normally reflected light using another method.

Figure 16:
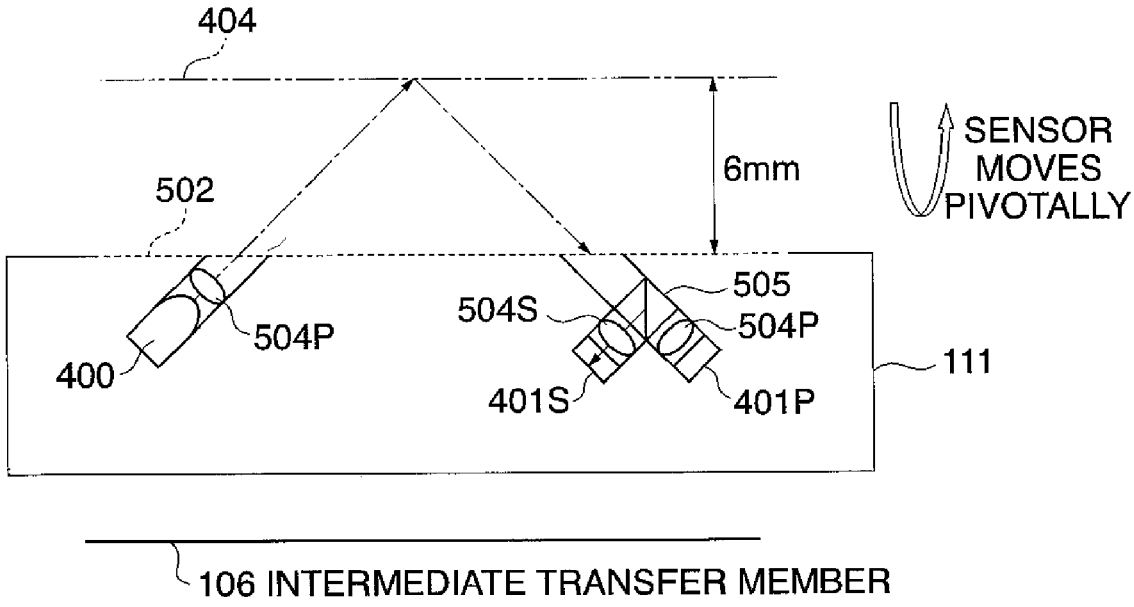
FIG. 16 is a diagram of the optical configuration of a density sensor of an image forming apparatus according to a fourth embodiment of the present invention.

FIG. 16 is a diagram of the optical configuration of a density sensor of an image forming apparatus according to a fourth embodiment of the present invention.

As shown in FIG. 16, a pivotally moving mechanism (not shown) for pivotally moving the entire density sensor 111 is provided to pivotally move the density sensor 111 by 180 degrees around the shutter 404 as the center. Then the shutter 404 is positioned on the opposite side of the intermediate transfer member 106. According to this configuration, the shutter 404 never contacts the intermediate transfer member 106.

The timing of pivotal movement of the density sensor 111 and open/close of the shutter 404 being characteristics of this embodiment should be timing to rotate the density sensor 111 and then close the shutter 404, similarly to the third embodiment. On the contrary, to open the shutter 404, it is important to open the shutter 404 first, and then rotate the density sensor to return the sensor to the original position. If the operation is not performed in the above order, the density sensor 111 may contact the intermediate transfer member 106.

Other Embodiments

The above embodiments have been described by referring to the intermediate transfer member referred to as the toner density sensor, or the density sensor for detecting the toner amount on the photosensitive drum. Many image forming apparatuses use optical sensors. It is possible to obtain the same advantageous effects described above by configurations in which other optical sensors are added to the configurations of the above embodiments. As such, the sensors are also within the scope of the present invention.

For example, a paper detecting sensor for detecting paper jam disclosed in Japanese Laid-Open Patent Publication (Kokai) No. H9-15922 is an optical sensor, which is not typically provided with a shutter, and has a similar problem of stains as the above. If the sensor gets stains, it cannot feed paper. Accordingly, a service person comes to perform cleaning or replacement.

In this embodiment, a photocatalytic film or coating agent is applied to the light emitting unit and the light receiving unit, and a shutter mirror receives normally reflected light of much radiant quantity, thereby decomposing stains containing organic substances such as paper dust.

The above paper detecting sensor usually has no protection film. In that case, a photocatalytic coating agent should be applied to the surface of the light emitting unit and the surface of the light receiving unit.

Moreover, a thin-film mirror having a photocatalytic function as disclosed in Japanese Laid-Open Patent Publication (Kokai) No. 2000-285716 can be bent. The thin-film mirror can be bent if the bent mirror can reflect ultraviolet rays from the light emitting unit on the light receiving unit. This can accomplish space-saving.

As described in the above, the above embodiments can use the optical sensor applied with a photocatalytic film or a coating agent to solve the problem of stains. The use efficiency of a photocatalytic material being the problem of the present invention can be improved, and a mirror, a half mirror or a diffuse reflector is used to achieve the photocatalytic effects for the density sensor used to detect the density of a visible image, thereby providing an image forming apparatus that is less influenced by stains.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Moreover, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-028274, filed Feb. 7, 2007, which is hereby incorporated by reference herein in its entirety.

What is claimed is:

1. An image forming apparatus comprising:

a light emitting unit adapted to irradiate an object to be irradiated with light;

a light receiving unit adapted to receive reflected light from the irradiated object;

a photocatalytic layer disposed so as to cover at least one of said light emitting unit or said light receiving unit, the photocatalytic layer containing a photocatalytic material; and a reflecting unit adapted to reflect light from said light emitting unit and guide the reflected light to said light receiving unit, wherein said light emitting unit is adapted to emit light of a wavelength range adapted to a bandgap width of said photocatalytic layer, and said light receiving unit is adapted to have sensitivity in a wavelength range of light emitted from said light emitting unit, wherein said light emitting unit is adapted to irradiate said reflecting unit with light if no object is detected, and wherein said reflecting unit is movably arranged between said light emitting unit and the irradiated object, and is adapted to move to a position not irradiated with light from said light emitting unit if the object to be irradiated is detected, and move to a position to be irradiated with light from said light emitting unit if no object is detected.

2. An image forming apparatus according to claim 1, wherein said photocatalytic layer forms a photocatalytic film.

3. An image forming apparatus according to claim 1, wherein said photocatalytic layer is formed by applying the photocatalytic material.

4. An image forming apparatus according to claim 1, wherein said reflecting unit is a diffuse reflector.

5. An image forming apparatus according to claim 1, wherein said reflecting unit is a specular reflector.

6. An image forming apparatus according to claim 1, wherein:

said photocatalytic layer contains at least $TiO_2$, and said light emitting unit is adapted to emit light of a wavelength range of 387 nm or less.

7. An image forming apparatus according to claim 5, further comprising:

a control apparatus adapted to determine whether or not to cause said light emitting unit to emit light if no object is detected, wherein if said control apparatus determines to cause said light emitting unit to emit light if no object is detected, said control apparatus causes said light emitting unit to emit light by an amount not less than an amount emitted in the case of normal image formation.

8. An image forming apparatus comprising:

a light emitting unit adapted to irradiate an object to be irradiated with light;

a light receiving unit adapted to receive reflected light from the irradiated object;

a photocatalytic layer disposed so as to cover at least one of said light emitting unit or said light receiving unit, the photocatalytic layer containing a photocatalytic material;

a light detecting unit, including said light emitting unit, said light receiving unit, and said photocatalytic layer, movably arranged in a direction toward the object to be irradiated or a direction away from the object to be irradiated; and a reflecting unit adapted to reflect light from said light emitting unit and guide the reflected light to said light receiving unit, wherein said light emitting unit is adapted to emit light of a wavelength range adapted to a bandgap width of said photocatalytic layer, and said light receiving unit is adapted to have sensitivity in a wavelength range of light emitted from said light emitting unit, wherein said light emitting unit is adapted to irradiate said reflecting unit with light if no object is detected, and wherein said light detecting unit is adapted to move to a position different from a position where the object to be irradiated is detected if said reflecting unit is irradiated with light from said light emitting unit.

9. An image forming apparatus comprising:

a light emitting unit adapted to irradiate an object to be irradiated with light;

a light receiving unit adapted to receive reflected light from the irradiated object;

a photocatalytic layer disposed so as to cover at least one of said light emitting unit or said light receiving unit, the photocatalytic layer containing a photocatalytic material; and an electrical storage unit electrically connected to said light emitting unit, wherein said light emitting unit is adapted to emit light of a wavelength range adapted to a bandgap width of said photocatalytic layer, and said light receiving unit is adapted to have sensitivity in a wavelength range of light emitted from said light emitting unit, and wherein said electrical storage unit is adapted to discharge electricity to said light emitting unit when a power supply to said image forming apparatus is cut off.

* * * * *